US011600930B2

(12) United States Patent
You et al.

(10) Patent No.: US 11,600,930 B2
(45) **Date of Patent: *Mar. 7, 2023**

(54) BROADBAND PANEL ARRAY ANTENNA

(71) Applicant: Ningbo University, Zhejiang (CN)

(72) Inventors: Yang You, Zhejiang (CN); Jifu Huang, Zhejiang (CN); Ling Zhang, Zhejiang (CN); Qingchun You, Zhejiang (CN); Yunlong Lu, Zhejiang (CN)

(73) Assignee: Ningbo University, Zhejiang (CN)

( * ) Notice: Subject to any disclaimer, the term of this patent is extended or adjusted under 35 U.S.C. 154(b) by 59 days.

This patent is subject to a terminal disclaimer.

(21) Appl. No.: 17/321,524

(22) Filed: May 17, 2021

(65) Prior Publication Data

US 2021/0359422 A1 Nov. 18, 2021

(30) Foreign Application Priority Data

May 18, 2020 (CN) ..... 202010417843.7

(51) Int. Cl.
*H01Q 21/00* (2006.01)
*H01Q 21/06* (2006.01)
(Continued)

(52) U.S. Cl.
CPC ..... *H01Q 21/064* (2013.01); *H01Q 1/422* (2013.01); *H01Q 9/045* (2013.01); *H01Q 13/26* (2013.01);
(Continued)

(58) Field of Classification Search
CPC ..... H01Q 21/064; H01Q 1/422; H01Q 9/045; H01Q 13/26; H01Q 21/005; H01Q 21/0068; H01Q 21/0087; H01Q 15/246; H01Q 21/0006; H01Q 21/061; H01Q 1/36; H01Q 1/38; H01Q 1/50; H01P 5/082; H01P 5/181
See application file for complete search history.

(56) References Cited

U.S. PATENT DOCUMENTS 10,784,579 B2 * 9/2020 You ..... H01P 5/19
10,790,592 B2 * 9/2020 You ..... H01P 5/12
(Continued)

FOREIGN PATENT DOCUMENTS

WO WO-2020133321 A1 * 7/2020
WO WO-2021150384 A1 * 7/2021
WO WO-2022099585 A1 * 5/2022 ..... H01Q 1/48

*Primary Examiner* — Vibol Tan
(74) *Attorney, Agent, or Firm* — JCIPRNET

(57) ABSTRACT

A broadband panel array antenna includes a polarization layer, a radiating layer and a feed layer which are sequentially stacked from top to bottom. The feed layer is used for converting a single path of TE10 mode signals into a plurality of paths of same-power in-phase TE10 mode signals and transmitting the plurality of paths of TE10 mode signals to the radiating layer. The radiating layer is used for radiating the plurality of paths of TE10 mode signals from the feed layer to a free space. The polarization layer is used for rotating the polarization direction of an electric field generated by the radiating layer to reduce the side lobe in an E-plane direction diagram and an H-plane direction diagram. The broadband panel array antenna has the advantages of being low in side lobe, high in gain and efficiency, and low in machining cost.

5 Claims, 9 Drawing Sheets

(51) Int. Cl.
*H01Q 1/42* (2006.01)
*H01Q 9/04* (2006.01)
*H01Q 13/26* (2006.01)

(52) U.S. Cl.
CPC ..... *H01Q 21/005* (2013.01); *H01Q 21/0068* (2013.01); *H01Q 21/0087* (2013.01)

(56) References Cited

U.S. PATENT DOCUMENTS 10,862,210 B2 * 12/2020 Behdad ..... H01Q 21/26
11,165,138 B2 * 11/2021 Franco ..... H01Q 25/001
11,381,000 B2 * 7/2022 You ..... H01Q 21/061

* cited by examiner

BROADBAND PANEL ARRAY ANTENNA

CROSS-REFERENCE TO RELATED APPLICATION

This application claims the priority benefit of China application serial no. 202010417843.7, filed on May 18, 2020. The entirety of the above-mentioned patent application is hereby incorporated by reference herein and made a part of this specification.

BACKGROUND

Technical Field

The invention relates to a panel array antenna, in particular to broadband panel array antenna.

Description of Related Art

With the increase of the communication data size in unit time in the modern information society, the shortage of spectrum resources is becoming ever serious, and the lower side of the microwave frequency band has become very crowded. The MMW band has a pure electromagnetic environment and available broadband spectrum resources, thus having become the optimal choice of high-rate mobile communication systems. As a frequency band near 80 GHz, E-Band has two symmetrical frequency bands 71-76 GHz and 81-86 GHz, possesses a total bandwidth up to 10 GHz and can meet the requirement for back transmission of 10-20 Gbps 5G stations.

In a wireless communication system, the radiating efficiency and effective gain of the antenna in an RF terminal device have a crucial influence on the existence of the signal to noise ratio of the wireless communication system, and the antenna is one of the key devices determining the performance of the wireless communication system. To meet the application requirements of E-band, existing broadband antennas mainly include feed antennas and panel array antennas according to different design principles. Wherein, the feed antennas have an effective gain that can be flexibly controlled, and are widely applied to aerospace and satellite communication systems, such as reflector array antennas and lens array antennas. However, the focal-diameter ratio should be considered to improve the overall efficiency of the feed antennas, which makes the overall size of the feed antennas large and makes it difficult to guarantee a low profile. The panel array antennas have a low profile and a low weight and can be easily integrated with other components, thus having gained increased attention. Compared with the feed antennas, the feed network of the panel array antennas can accurately control the excitation amplitude and phase of the array unit, thus having higher aperture efficiency.

The existing panel array antennas typically include a feed network layer and a plurality of radiating layers, and the energy distribution of the radiating layers is adjusted by controlling the power distribution of the feed layer, so as to decrease the side lobe. However, the decrease of the side lobe of the existing panel array antennas may widen the main lobe and reduce the gain, which makes is impossible to gain an extremely low side lobe under the precondition that a narrow main lobe is guaranteed and the gain is not compromised. In addition, traditional panel array antennas have high requirements for the welding precision of the feed network layer and the plurality of radiating layer, which results in high machining costs and limits their production and application.

SUMMARY

The technical issue to be settled by the invention is to provide a broadband panel array antenna which is low in side lobe, high in gain and efficiency, and low in machining cost.

The technical solution adopted by the invention to settle the aforesaid technical issues is as follows: a broadband panel array antenna includes a polarization layer, a radiating layer and a feed layer which are sequentially stacked from top to bottom; the feed layer is used for converting a single path of TE10 mode signals into a plurality of paths of same-power in-phase TE10 mode signals and transmitting the plurality of paths of TE10 mode signals to the radiating layer, the radiating layer is used for radiating the plurality of paths of TE10 mode signals from the feed layer to a free space, and the polarization layer is used for rotating the polarization direction of an electric field generated by the radiating layer to reduce the side lobe in an E-plane direction diagram and an H-plane direction diagram.

The polarization layer includes a dielectric substrate, a first metal layer disposed on a lower surface of the dielectric substrate, and a second metal layer disposed on an upper surface of the dielectric substrate, wherein the dielectric substrate is made of plastic and is of a rectangular structure, the lengthwise direction of the dielectric substrate is defined as a left-right direction, and the widthwise direction of the dielectric substrate is defined as a front-back direction; the first metal layer includes M first metal strips attached to the lower surface of the dielectric substrate, M is an integer which is greater than or equal to 2, each first metal strip is of a rectangular structure, the M first metal strips are identical in size and are regularly disposed at intervals from front to back, the left end face of each first metal strip is located on the same plane as the left end face of the dielectric substrate, the right end face of each first metal strip is located on the same plane as the right end face of the dielectric substrate, the front end face of the foremost first metal strip is located on the same plane as the front end face of the dielectric substrate, and the rear end face of the rearmost first metal strip is located on the same plane as the rear end face of the dielectric substrate; the center distance between every two adjacent first metal strips is 0.1λ, λ=c/f, c is the wave velocity and meets: c=3*10^8 m/s, and f is the center operating frequency of the broadband panel array antenna; the second metal layer includes M second metal strips attached to the upper surface of the dielectric substrate, each second metal strip is in an isosceles trapezoid shape, a connecting line between the midpoint of an upper line and the midpoint of a lower line of each second metal strip is located on a vertical plane where a diagonal line of the upper surface of the dielectric substrate is located, planes where two legs of each second metal strip are located overlap with planes where two adjacent end faces of the dielectric substrate are located, and the M first metal strips are in one-to-one correspondence with the M second metal strips; and regarding the first metal strips and the second metal strips corresponding to the first metal strips, if the first metal strips are mapped onto the upper surface of the dielectric substrate and are then anticlockwise rotated by 45°, the front end faces of the first metal strips overlap with the upper lines of the second metal strips, and the rear end faces of the first metal strips overlap with the lower lines of the second metal strips. The polarization layer enables the polarization direction of the electric field generated by the radiating layer to rotate in the rotating direction of the first metal strips and the second metal strips, so that energy in the diagonal direction of the panel array antenna represents a good tapered distribution, and the side lobe in the E-plane direction diagram and the H-plane direction diagram is reduced to realize a low side lobe.

The radiating layer includes a first panel and a radiating array disposed on the first panel, wherein the first panel is rectangular, the radiating array is formed by $n^2$ radiating units which are distributed in $2^{(k-1)}$ rows and $2^{(k-1)}$ columns, $n=2^{(k-1)}$, k is an integer which is greater than or equal to 3, the center distance between every two adjacent radiating units in the same row is 1.8λ, and the center distance between every two adjacent radiating units in the same column is 1.8λ; the radiating unit includes two first radiating elements and two second radiating elements, wherein the two first radiating elements are parallelly arranged left and right in a spaced manner, the first radiating element on the left overlaps with the first radiating element on the right after being moved rightwards by 0.9λ, the two second radiating elements are arranged left and right in a spaced manner, the second radiating element on the left overlaps with the second radiating element on the right after being moved rightwards by 0.9λ, the two second radiating elements are located behind the two first radiating elements, the center distance between the second radiating element on the left and the first radiating element on the left is 0.9λ, the second radiating element on the left and the first radiating element on the left are symmetrical front and back, the center distance between the second radiating element on the right and the first radiating element on the right is 0.9λ, and the second radiating element on the right and the first radiating element on the right are symmetrical front and back; the first radiating element includes a first rectangular cavity, a second rectangular cavity, a third rectangular cavity, a fourth rectangular cavity, a first rectangular matching board, a second rectangular matching board and a third rectangular matching board, wherein the first rectangular cavity, the second rectangular cavity, the third rectangular cavity and the fourth rectangular cavity are formed in the first panel and are sequentially stacked and communicated from top to bottom, the center of the first rectangular cavity, the center of the second rectangular cavity, the center of the third rectangular cavity and the center of the fourth rectangular cavity are located on the same straight line, the front end face of the first rectangular cavity, the front end face of the second rectangular cavity, the front end face of the third rectangular cavity and the front end face of the fourth rectangular cavity are parallel to the front end face of the first panel, the upper end face of the first rectangular cavity is located on the same plane as the upper end face of the first panel, the upper end face of the second rectangular cavity is located on the same plane as the lower end face of the first rectangular cavity, the upper end face of the third rectangular cavity is located on the same plane as the lower end face of the second rectangular cavity, the upper end face of the fourth rectangular cavity is located on the same plane as the lower end face of the third rectangular cavity, the lower end face of the fourth rectangular cavity is located on the same plane as the lower end face of the first panel, the left-right length of the first rectangular cavity is 0.8λ, the front-back length of the first rectangular cavity is 0.7λ, the height of the first rectangular cavity is 0.25λ, the left-right length of the second rectangular cavity is 0.6λ, the front-back length of the second rectangular cavity is 0.5λ, the height of the second rectangular cavity is 0.125 λ, the left-right length of the third rectangular cavity is 0.6λ, the front-back length of the third rectangular cavity is less than 0.5λ, the height of the third rectangular cavity is 0.25λ, the left-right length of the fourth rectangular cavity is half that of the first rectangular cavity, the front-back length of the fourth rectangular cavity is two fifths that of the first rectangular cavity, the first rectangular matching board and the second rectangular matching board are located in the third rectangular cavity, the rear wall of the first rectangular matching board is attached and integrally connected to the rear wall of the third rectangular cavity, the distance from the left end face of the first rectangular matching board to the left end face of the third rectangular cavity is equal to the distance from the right end face of the first rectangular matching board to the right end face of the third rectangular cavity, the left-right length of the first rectangular matching board is a quarter that of the third rectangular cavity, the front-back length of the first rectangular matching board is one-tenth that of the third rectangular cavity, the upper end face of the first rectangular matching board is located on the same plane as the upper end face of the third rectangular cavity, the lower end face of the first rectangular matching board is located on the same plane as the lower end face of the third rectangular cavity, the second rectangular matching board and the first rectangular matching board are symmetrical front and back with respect to a front-back bisection plane of the third rectangular cavity, the third rectangular matching board is located in the fourth rectangular cavity, the front wall of the third rectangular matching board is attached and integrally connected to the front wall of the fourth rectangular cavity, the distance from the left end face of the third rectangular matching board to the left end face of the fourth rectangular cavity is equal to the distance from the right end face of the third rectangular matching board to the right end face of the fourth rectangular cavity, the upper end face of the third rectangular matching board is located on the same plane as the upper end face of the fourth rectangular cavity, the lower end face of the third rectangular matching board is located on the same plane as the lower end face of the fourth rectangular cavity, the left-right length of the third rectangular matching board is three tenths that of the fourth rectangular cavity, the front-back length of the third rectangular matching board is half that of the fourth rectangular cavity, and the lower end face of the fourth rectangular cavity is used as an input terminal of the first radiating element; the input terminals of the two first radiating elements and input terminals of the two second radiating elements are used as fourth input terminals of the radiating unit, the four input terminals of each radiating unit are used as four input terminals of the radiating layer, the radiating layer has $4*n^2$ input terminals, the upper end face of the first rectangular cavity is used as an output terminal of the first radiating element, the output terminals of the two first radiating elements and output terminals of the two second radiating elements are used as four output terminals of the radiating unit, the four output terminals of each radiating unit are used as four output terminals of the radiating layer, the radiating layer has $4*n^2$ output terminals, $4*n^2$ paths of TE10 mode signals output by the feed layer are accessed to the $4*n^2$ input terminals of the radiating layer in a one-to-one corresponding manner, and the $4*n^2$ output terminals of the radiating layer are used for radiating the $4*n^2$ paths of TE10 mode signals output by the feed layer to the free space in a one-to-one corresponding manner. Each radiating unit in the radiating layer is constructed based on a multiplayer coupling structure formed by the first rectangular cavity, the second rectangular cavity, the third rectangular cavity and the fourth rectangular cavity which are stacked from top to bottom, so that the radiating layer guarantees a broadband and a high gain, has low cost and can realize miniaturization.

The feed layer includes a second panel, and $$\left(\frac{n}{2^1}\right)^2$$

first-stage H-type E-plane waveguide power dividing network units and a standard waveguide input port disposed on the second panel, wherein the second panel is rectangular; each first-stage H-type E-plane waveguide power dividing network unit includes a first-stage H-type E-plane waveguide power dividing network and a second-stage H-type E-plane waveguide power divider, wherein the second-stage H-type E-plane waveguide power divider has an input terminal and four output terminals and is used for dividing one path of signals input to the input terminal thereof into four paths of same-power in-phase signals, which are then respectively output by the output terminals thereof, the input terminal of the second-stage H-type E-plane waveguide power divider is used as an input terminal of the first-stage H-type E-plane waveguide power dividing network unit, the first-stage H-type E-plane waveguide power dividing network includes two first H-type E-plane waveguide power dividing networks and two second H-type E-plane waveguide power dividing networks, the two first H-type E-plane waveguide power dividing networks are parallelly arranged left and right in a spaced manner, the first H-type E-plane waveguide power dividing network on the left overlaps with the first H-type E-plane waveguide power dividing network on the right after being moved rightwards by 1.8λ, the two second H-type E-plane waveguide power dividing networks are arranged left and right in a spaced manner, the second H-type E-plane waveguide power dividing network on the left overlaps with the second H-type E-plane waveguide power dividing network on the right after being moved rightwards by 1.8λ, the two second H-type E-plane waveguide power dividing networks are located behind the two first H-type E-plane waveguide power dividing networks, the center distance between the second H-type E-plane waveguide power dividing network on the left and the first H-type E-plane waveguide power dividing network on the left is 1.8λ, the second H-type E-plane waveguide power dividing network on the left and the first H-type E-plane waveguide power dividing network on the left are symmetrical front and back, the center distance between the second H-type E-plane waveguide power dividing network on the right and the first H-type E-plane waveguide power dividing network on the right is 1.8λ, and the second H-type E-plane waveguide power dividing network on the right and the first H-type E-plane waveguide power dividing network on the right are symmetrical front and back; the first H-type E-plane waveguide power dividing network includes a first-stage H-type E-plane waveguide power divider and four E-plane rectangular waveguide-single ridge waveguide converters, wherein the first-stage H-type E-plane waveguide power divider has an input terminal and four output terminals and divides one path of signals input to the input terminal thereof into four paths of same-power in-phase signals, which are then respectively output by the four output terminals thereof, each E-plane rectangular waveguide-single ridge waveguide converter has an input terminal and an output terminal and is used for converting a rectangular waveguide accessed to the input terminal thereof into a single ridge waveguide, which is then output by the output terminal thereof, the input terminals of the four E-plane rectangular waveguide-single ridge waveguide converters are connected to the four output terminals of the first-stage H-type E-plane waveguide power divider in a one-to-one corresponding manner, the output terminal of each E-plane rectangular waveguide-single ridge waveguide converter is used as an output terminal of the first H-type E-plane waveguide power dividing network, the first H-type E-plane waveguide power dividing network has four output terminals, the four output terminals of each of the two first H-type E-plane waveguide power dividing networks and four output terminals of each of the two second H-type E-plane waveguide power dividing networks are used as the output terminals of the first-stage H-type E-plane waveguide power dividing network unit, each first-stage H-type E-plane waveguide power dividing network unit has sixteen output terminals, the $$\left(\frac{n}{2^1}\right)^2$$

first-stage H-type E-plane waveguide power dividing network units has $$16*\left(\frac{n}{2^1}\right)^2$$

output terminals, and the $$16*\left(\frac{n}{2^1}\right)^2$$

output terminals of the $$\left(\frac{n}{2^1}\right)^2$$

first-stage H-type E-plane waveguide power dividing network units are used as $$16*\left(\frac{n}{2^1}\right)^2$$

output terminals of the feed layer and are connected to the $4n^2$ input terminals of the radiating layer in a one-to-one corresponding manner; the $$\left(\frac{n}{2^1}\right)^2$$

first-stage H-type E-plane waveguide power dividing network units are uniformly distributed in $$\frac{n}{2^1}$$

rows and $$\frac{n}{2^1}$$

columns at intervals to form a first-stage feed network array, the center distance between every two adjacent first-stage H-type E-plane waveguide power dividing network units in the same row is 3.6λ, and the center distance between every two adjacent first-stage H-type E-plane waveguide power dividing network units in the same column is 3.6λ; from the first row and the first column of the first-stage feed network array, the four first-stage H-type E-plane waveguide power dividing network units in every two rows and columns constitute a first-stage network unit group, the first-stage feed network array includes $$\left(\frac{n}{2^2}\right)^2$$

first-stage network unit groups in total, each first-stage network unit group includes a third-stage H-type E-plane waveguide power divider which has an input terminal and four output terminals and is used for dividing one path of signals input to the input terminal thereof into four paths of same-power in-phase signals, which are then output by the four output terminals thereof, the four output terminals of the third-stage H-type E-plane waveguide power divider are connected to the input terminals of the four first-stage H-type E-plane waveguide power dividing network units in the first-stage network unit group in a one-to-one corresponding manner, each first-stage network unit group and the third-stage H-type E-plane waveguide power divider connected to the first-stage network unit group constitute a second-stage H-type E-plane waveguide power dividing network unit, the input terminal of the third-stage H-type E-plane waveguide power divider is used as an input terminal of the second-stage H-type E-plane waveguide power dividing network unit, and $$\left(\frac{n}{2^2}\right)^2$$

second-stage H-type E-plane waveguide power dividing network units which are distributed in $$\frac{n}{2^2}$$

rows and $$\frac{n}{2^2}$$

columns are obtained in total and constitute a second-stage feed network array; from the first row and the first column of the second-stage feed network array, the four second-stage H-type E-plane waveguide power dividing network unit in every two rows and columns constitute a second-stage network unit group, the second-stage feed network array includes $$\left(\frac{n}{2^3}\right)^2$$

second-stage network unit groups, the input terminal of the third-stage H-type E-plane waveguide power divider of each second-stage H-type E-plane waveguide power dividing network unit in the second-stage network unit group is used as an input terminal of the second-stage network unit group, and the second-stage network unit group has four input terminals; each second-stage network unit group includes a fourth-stage H-type E-plane waveguide power divider which has an input terminal and four output terminals and is used for dividing one path of signals input to the input terminal thereof into four paths of same-power in-phase signals, which are then respectively output by the four output terminals thereof, and the four output terminals of the fourth-stage H-type E-plane waveguide power divider are connected to the four input terminal of the second-stage network unit group in a one-to-one corresponding manner; each second-stage network unit group and the fourth-stage H-type E-plane waveguide power divider connected to the second-stage network unit group constitute a third-stage H-type E-plane waveguide power dividing network unit, the input terminal of the fourth-stage H-type E-plane waveguide power divider is used as an input terminal of the third-stage H-type E-plane waveguide power dividing network unit, and $$\left(\frac{n}{2^3}\right)^2$$

third-stage H-type E-plane waveguide power dividing network units which are distributed in $$\frac{n}{2^3}$$

rows and $$\frac{n}{2^3}$$

columns are obtained in total and constitute a third-stage feed network array; by analogy, $$\left(\frac{n}{2^{k-2}}\right)^2$$

(k-2)th-stage H-type E-plane waveguide power dividing network units constitute a (k-2)th feed network array, a (k-1)th-stage H-type E-plane waveguide power divider is arranged among the four (k-2)th-stage H-type E-plane waveguide power dividing network units in the (k-2)th feed network array, has an input terminal and four output terminals, and is used for dividing one path of signals input to the input terminal thereof into four paths of same-power in-phase signals, which are then respectively output by the four output terminals thereof, the four output terminals of the (k-1)th-stage H-type E-plane waveguide power divider are connected to the input terminals of the four (k-2)th-stage H-type E-plane waveguide power dividing network units in a one-to-one corresponding manner, the input terminal of the (k-1)th-stage H-type E-plane waveguide power divider is connected to the standard waveguide input port, the standard waveguide input port is used as an input terminal of the feed layer, and the input terminal of the feed layer is connected to an external signal port.

The E-plane rectangular waveguide-single ridge converter includes a first rectangular metal block, wherein a rectangular port and a fifth rectangular cavity are formed in the first rectangular metal block, the rectangular port is the input terminal of the E-plane rectangular waveguide-single ridge converter, the upper end face of the rectangular port is a certain distance away from the upper end face of the first rectangular metal block, the front end face of the rectangular port is located on the same plane as the front end face of the first rectangular metal block, the upper end face of the fifth rectangular cavity is located on the same plane as the upper end face of the first rectangular metal block, the right end face of the fifth rectangular cavity is located on the same plane as the right end face of the rectangular port, the front end face of the fifth rectangular cavity is connected and attached to the rear end face of the rectangular port, the lower end face of the fifth rectangular cavity is located on the same plane as the lower end face of the rectangular port, a plane where the left end face of the rectangular port is located is a certain distance away from a plane where the left end face of the fifth rectangular cavity is located, the left end face of the fifth rectangular cavity is a certain distance away from the left end face of the first rectangular metal block, the distance from the left end face of the fifth rectangular cavity to the left end face of the first rectangular metal block is equal to the distance from the right end face of the fifth rectangular cavity to the right end face of the first rectangular metal block, the lower end face of the fifth rectangular cavity is a certain distance away from the lower end face of the first rectangular metal block, a single-ridge step, an E-plane step and an H-plane step are disposed in the fifth rectangular cavity and are all rectangular blocks, the right end face of the H-plane step is connected and attached to the right end face of the fifth rectangular cavity, the lower end face of the H-plane step is connected and attached to the lower end face of the fifth rectangular cavity, the left end face of the H-plane step is connected and attached to the right end face of the single-ridge step, the lower end face of the single-ridge step is connected and attached to the lower end face of the fifth rectangular cavity, the upper end face of the single-ridge step is located on the same plane as the upper end face of the fifth rectangular cavity, the left end face of the single-ridge step is connected and attached to the right end face of the E-plane step, the left end face of the E-plane step is connected and attached to the left end face of the fifth rectangular cavity, and the lower end face of the E-plane step is connected and attached to the lower end face of the fifth rectangular cavity; the front-back length of the H-plane step is half that of the fifth rectangular cavity, the left-right length of the H-plane step is one third that of the fifth rectangular cavity, the vertical length of the H-plane step is two fifths that of the fifth rectangular cavity, the front-back length of the single-ridge step is half that of the fifth rectangular cavity, the left-right length of the single-ridge step is one third that of the fifth rectangular cavity, the vertical length of the single-ridge step is equal to that of the fifth rectangular cavity, the front-back length of the E-plane step is equal to that of the fifth rectangular cavity, the left-right length of the E-plane step is one third that of the fifth rectangular cavity, the vertical length of the E-plane step is a quarter that of the fifth rectangular cavity, and the upper end face of the fifth rectangular cavity is the output terminal of the E-plane rectangular waveguide-single ridge converter; the first-stage H-type E-plane waveguide power divider includes a first rectangular block, a second rectangular block, a third rectangular block, a first matching block, a second matching block and a fourth rectangular block, wherein the upper end face of the first rectangular block, the upper end face of the second rectangular block, the upper end face of the third rectangular block, the upper end face of the first matching block, the upper end face of the second matching block and the upper end face of the fourth matching block are located on the same plane, the left end face of the first rectangular block is parallel to the left end face of the second panel, the front-back length of the first rectangular block is 0.7λ, the left-right length of the first rectangular block is 0.125λ, the vertical length of the first rectangular block is 0.8λ, the left end face of the third rectangular block is connected and attached to the right end face of the first rectangular block, the front-back length of the third rectangular block is 0.125λ, the left-right length of the third rectangular block is 0.9λ, the vertical length of the third rectangular block is 0.8λ, the distance from a plane where the front end face of the third rectangular block is located to a plane where the front end face of the first rectangular block is located is equal to the distance from a plane where the rear end face of the third rectangular block is located to a plane where the rear end face of the first rectangular block is located, the right end face of the third rectangular block is connected and attached to the left end face of the second rectangular block, the front-back length of the second rectangular block is 0.7λ, the left-right length of the second rectangular block is 0.125λ, the vertical length of the second rectangular block is 0.8λ, the distance from a plane where the front end face of the third rectangular block is located to a plane where the front end face of the second rectangular block is located is equal to the distance from a plane where the rear end face of the third rectangular block is located to a plane where the rear end face of the second rectangular block is located, the first matching block is a rectangular block, the left end face of the first matching block is connected and attached to the right end face of the first rectangular block, the rear end face of the first matching block is connected and attached to the front end face of the third rectangular block, the front-back length of the first matching block is one-tenth that of the first rectangular block, the left-right length of the first matching block is four fifths that of the first rectangular block, the vertical length of the first matching block is 0.8λ, the second matching block and the first matching block are symmetrical left and right with respect to a front-back midline of the third rectangular block, the front end face of the fourth rectangular block is connected and attached to the rear end face of the third rectangular block, the distance from the left end face of the fourth rectangular block to the right end face of the first rectangular block is equal to the distance from the right end face of the fourth rectangular block to the left end face of the second rectangular block, the left-right length of the fourth rectangular block is 1.25 times that of the first rectangular block, the vertical length of the fourth rectangular block is 0.8λ, and the front end face of the first rectangular block, the rear end face of the first rectangular block, the front end face of the second rectangular block and the rear end face of the second rectangular block are used as the four output terminals of the first-stage H-type E-plane waveguide power divider respectively; the second-stage H-type E-plane waveguide power divider includes a fifth rectangular block, a sixth rectangular block, a seventh rectangular block, an eighth rectangular block, a first conversion block, a second conversion block, a third conversion block and a fourth conversion block, wherein the upper end face of the fifth rectangular block, the upper end face of the sixth rectangular block, the upper end face of the seventh rectangular block, the upper end face of the first conversion block, the upper end face of the second conversion block, the upper end face of the third conversion block, the upper end face of the fourth conversion block and the upper end face of the eighth rectangular block are located on the same plane, the front-back length of the fifth rectangular block is 1.2λ, the left-right length of the fifth rectangular block is 0.125λ, the vertical length of the fifth rectangular block is 0.8λ, a first rectangular recess is formed in the left end face of the fifth rectangular block, the vertical length of the first rectangular recess is equal to that of the fifth rectangular block, the front-back length of the first rectangular recess is smaller than that of the fifth rectangular cavity, the left-right length of the first rectangular recess is smaller than that of the fifth rectangular cavity, the distance from a plane where the front end face of the first rectangular recess is located to a plane where the front end face of the fifth rectangular block is located is equal to the distance from a plane where the rear end face of the first rectangular recess to a plane where the rear end face of the fifth rectangular block is located, the sixth rectangular block and the fifth rectangular block are symmetrical left and right, the center distance between the sixth rectangular block and the fifth rectangular block is 1.9λ, the left end face of the seventh rectangular block is connected and attached to the right end face of the fifth rectangular block, the right end face of the seventh rectangular block is connected and attached to the left end face of the sixth rectangular block, the front-back length of the seventh rectangular block is 0.2λ, the left-right length of the seventh rectangular block is 1.9λ, the vertical length of the seventh rectangular block is 0.8λ, the distance from a plane where the front end face of the seventh rectangular block is located to a plane where the front end face of the fifth rectangular block is located is equal to the distance from a plane where the rear end face of the seventh rectangular block is located to a plane where the rear end face of the fifth rectangular block is located, a stepped recess is formed in the front end face of the seventh rectangular cavity and includes a second rectangular recess and a third rectangular recess which are communicated with each other, the vertical length of the second rectangular recess and the third rectangular recess is equal to that of the seventh rectangular block, the left-right length of the second rectangular recess is smaller than that of the third rectangular recess, the left-right length of the third rectangular recess is smaller than that of the seventh rectangular block, the front-back length of the second rectangular recess is smaller than that of the third rectangular recess, the sum of the front-back length of the second rectangular recess and the front-back length of the third rectangular recess is smaller than the front-back length of the seventh rectangular block, the front end face of the third rectangular recess is located on the same plane as the front end face of the seventh rectangular block, the rear end face of the third rectangular recess is connected and attached to the front end face of the second rectangular recess, the distance from the left end face of the third rectangular recess to the left end face of the seventh rectangular block is equal to the distance from the right end face of the third rectangular recess to the right end face of the seventh rectangular block, and the distance from the left end face of the second rectangular recess to the left end face of the seventh rectangular block is equal to the distance from the right end face of the second rectangular recess to the right end face of the seventh rectangular block; the left-right length of the eighth rectangular block is 1.1 times that of the fifth rectangular block, the front end face of the eighth rectangular block is connected and attached to the rear end face of the seventh rectangular block, the distance from the left end face of the eighth rectangular block to the right end face of the fifth rectangular block is equal to the distance from the right end face of the eighth rectangular block to the left end face of the sixth rectangular block, the vertical length of the eighth rectangular block is 0.8λ, the front-back length of the eighth rectangular block is 0.2λ, the left-right length of the eighth rectangular block is 0.2λ, and the rear end face of the eighth rectangular block is the input terminal of the second-stage H-type E-plane waveguide power divider; the first conversion block consists of a ninth rectangular block, a first right-angle triangular block, a second right-angle triangular block and a parallelogram block, wherein the ninth rectangular block, the first right-angle triangular block, the second right-angle triangular block and the parallelogram block are located on the same plane, the front end face of the ninth rectangular block is the front end face of the first conversion block, the left-right length of the ninth rectangular block is equal to 0.2λ, the vertical length of the ninth rectangular block is equal to 0.8λ, the end face where a first right-angle side of the first right-angle triangular block is located is connected and attached to the rear end face of the ninth rectangular block, the length of the end face where the first right-angle side of the first right-angle triangular block is located is equal to the left-right length of the ninth rectangular block, the end face, where a second right-angle side of the first right-angle triangular block is located, is located on the same plane as the left end face of the ninth rectangular block, the vertical length of the first right-angle triangular block is equal to that of the ninth rectangular block, the end face where a first right-angle side of the second right-angle triangular block is located is connected and attached to the front end face of the fifth rectangular block, the end face, where a second right-angle side of the second right-angle triangular block is located, is located on the same plane as the right end face of the fifth rectangular block, the length of the end face where the first right-angle side of the second right-angle triangular block is located is equal to the left-right length of the fifth rectangular block, the vertical length of the second right-angle triangular block is equal to that of the fifth rectangular block, the front end face of the parallelogram block completely overlaps with the end face where a hypotenuse of the second right-angle second triangular block is located, the distance between the front end face and the rear end face of the parallelogram block is 0.2λ, the vertical length of the parallelogram block is equal to that of the second right-angle triangular block, an angle between the end face where the first right-angle side of the first right-angle triangular block is located and the end face where a hypotenuse of the first right-angle second triangular block is located is 22.5°, and an angle between the end face where the first right-angle side of the second right-angle triangular block is located and the end face where the hypotenuse of the second right-angle second triangular block is located is 22.5°; the second conversion block and the first conversion block are symmetrical left and right, the third conversion block overlaps with the second conversion block after being moved rightward by 1.9λ, the third conversion block and the first conversion block are symmetrical front and back, the center distance between the third conversion block and the first conversion block is 1.2λ, the fourth conversion block and the second conversion block are symmetrical front and back, and the front end face of the first conversion block, the front end face of the second conversion block, the front end face of the third conversion block and the front end face of the fourth conversion block are used as the four output terminals of the second-stage H-type E-plane waveguide power divider; the hth-stage H-type E-plane waveguide power divider is identical in structure with the second-stage H-type E-plane waveguide power divider, but the size is increased gradually, and h=3, 4, . . . , k-1; when the four output terminals of each first-stage H-type E-plane waveguide power divider are connected to the input terminals of four E-plane rectangular waveguide-single ridge waveguide converters in a one-to-one corresponding manner, each output terminal of the first-stage H-type E-plane waveguide power divider is attached to and completely overlaps with the input terminal of one E-plane rectangular waveguide-single ridge waveguide converter; when the four output terminals of each second-stage H-type E-plane waveguide power divider are connected to the input terminals of four first-stage H-type E-plane waveguide power dividers in a one-to-one corresponding manner, each output terminal of the second-stage H-type E-plane waveguide power divider is attached to and completely overlaps with the input terminal of one first-stage H-type E-plane waveguide power divider; and when the four output terminals of the hth-stage H-type E-plane waveguide power divider are connected to the input terminals of four (h-1)th-stage H-type E-plane waveguide power dividers in a one-to-one corresponding manner, each output terminal of the hth-stage H-type E-plane waveguide power divider is attached to and completely overlaps with the input terminal of one (h-1)th-stage H-type E-plane waveguide power divider. In the structure, the single-ridge steps, the H-plane steps and the E-plane steps arranged in the E-plane rectangular waveguide-single ridge waveguide converters realize impedance matching, reduce the return loss caused by the discontinuity of the structure, so that the panel array antenna has good broadband transmission properties and can uniformly feed power to the radiating units in the radiating layer and broaden the dominant-mode bandwidth, and ultra-wideband and high-efficiency feed of the array antenna is realized.

Compared with the prior art, the invention has the following advantages: the polarization layer is additionally disposed over the radiating layer and enables the polarization direction of the electric field generated by the radiating layer to rotate to reduce the side lobe in the E-plane direction diagram and the H-plane direction diagram is reduced to realize a low side lobe; in addition, a multi-stage radiating structure of traditional panel antennas is optimized into one radiating layer, so that the profile height of the panel antenna is greatly reduced under the condition that a broadband structure is realized, machining and assembly requirements are effectively reduced, high assembly precision can be realized more easily, and the low-profile and small-sized design reduces the loss of an interlayer coupling structure of the traditional panel antennas and significantly improves the gain and aperture efficiency of the antenna, so the broadband panel array antenna is low in side lobe, high in gain and efficiency, and low in machining cost.

DESCRIPTION OF THE EMBODIMENTS

The invention will be described in further detail below in conjunction with the accompanying drawings.

Figure 1:
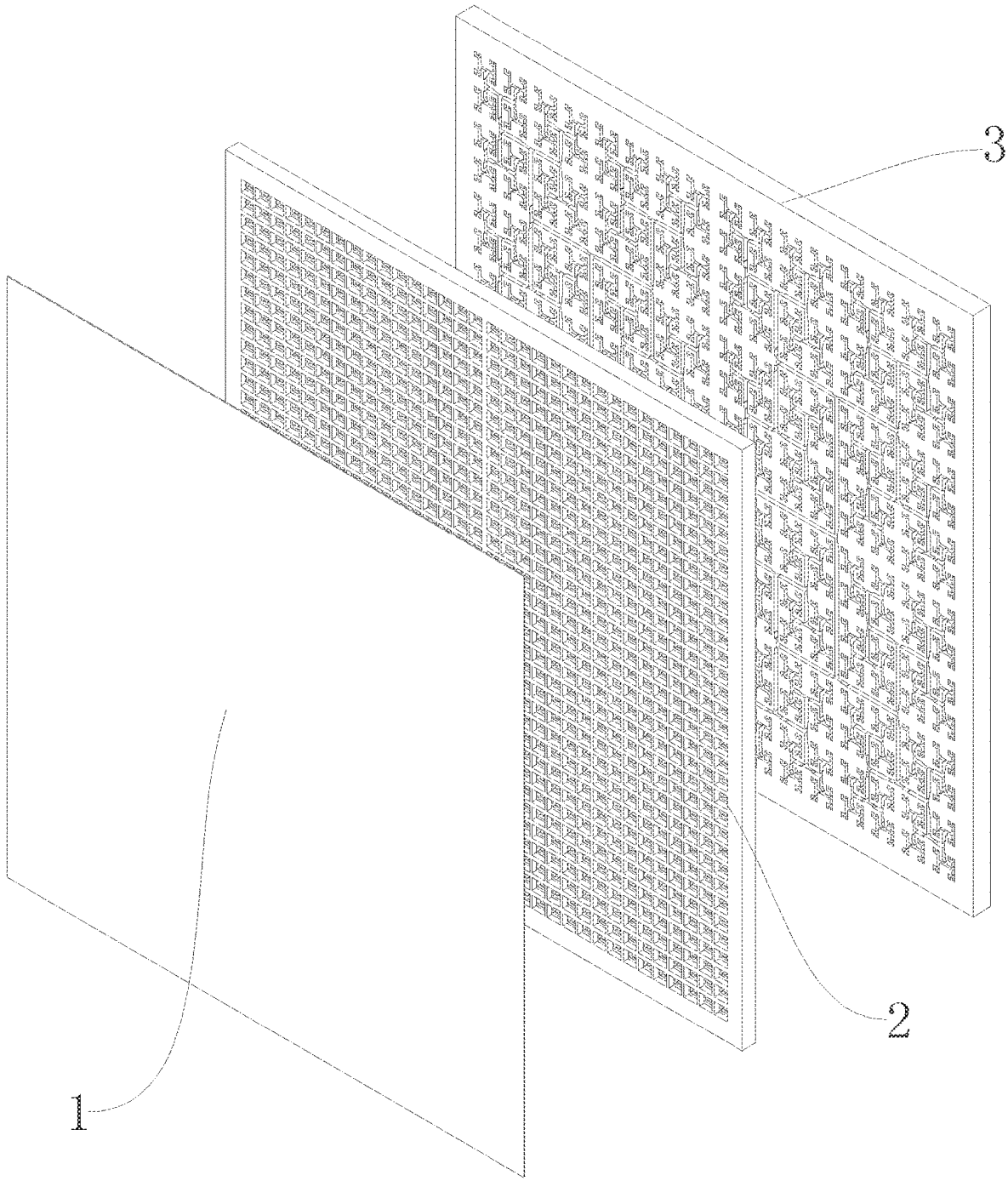
FIG. 1 is an exploded view of a broadband panel array antenna of the invention.

Embodiment: As shown in FIG. 1, a broadband panel array antenna includes a polarization layer 1, a radiating layer 2 and a feed layer 3 which are sequentially stacked from top to bottom; the feed layer 3 is used for converting a single path of TE10 mode signals into a plurality of paths of same-power in-phase TE10 mode signals and transmitting the plurality of paths of TE10 mode signals to the radiating layer 2, the radiating layer 2 is used for radiating the plurality of paths of TE10 mode signals from the feed layer 3 to a free space, and the polarization layer 1 is used for rotating the polarization direction of an electric field generated by the radiating layer 2 to reduce the side lobe in an E-plane direction diagram and an H-plane direction diagram.

Figure 2:
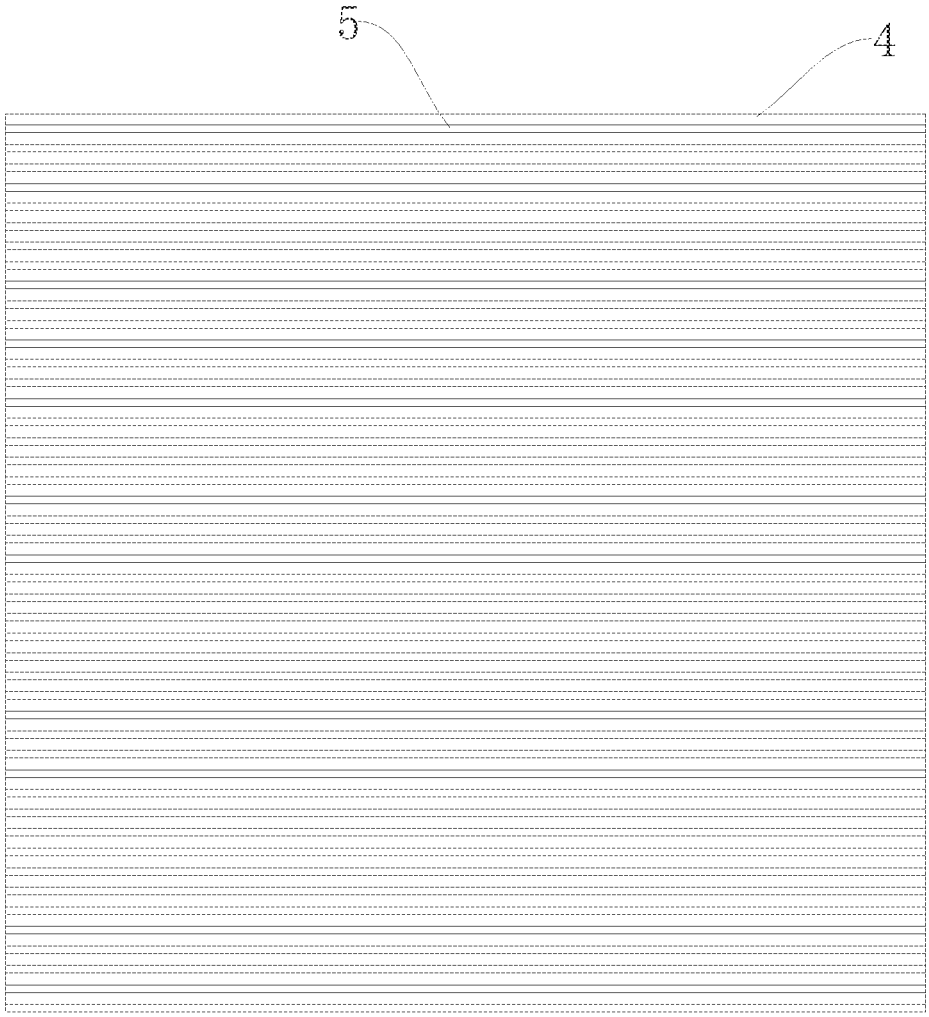
FIG. 2 is a bottom view of a polarization layer of the broadband panel array antenna of the invention.
Figure 3:
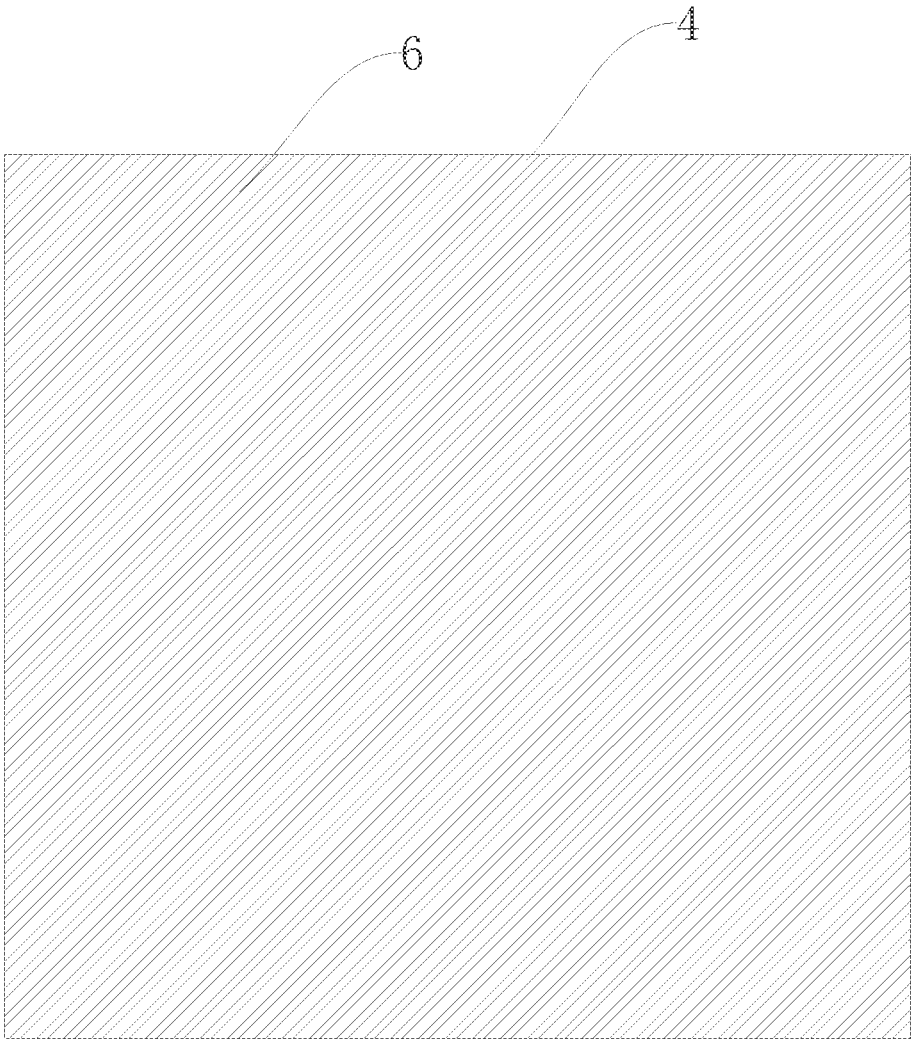
FIG. 3 is a top view of the polarization layer of the broadband panel array antenna of the invention.

In this embodiment, as shown in FIG. 2 and FIG. 3, the polarization layer 1 includes a dielectric substrate 4, a first metal layer disposed on a lower surface of the dielectric substrate 4, and a second metal layer disposed on an upper surface of the dielectric substrate 4, wherein the dielectric substrate 4 is made of plastic and is of a rectangular structure, the lengthwise direction of the dielectric substrate 4 is defined as a left-right direction, and the widthwise direction of the dielectric substrate 4 is defined as a front-back direction; the first metal layer includes M first metal strips 5 attached to the lower surface of the dielectric substrate 4, M is an integer which is greater than or equal to 2, each first metal strip 5 is of a rectangular structure, the M first metal strips 5 are identical in size and are regularly disposed at intervals from front to back, the left end face of each first metal strip 5 is located on the same plane as the left end face of the dielectric substrate 4, the right end face of each first metal strip 5 is located on the same plane as the right end face of the dielectric substrate 4, the front end face of the foremost first metal strip 5 is located on the same plane as the front end face of the dielectric substrate 4, and the rear end face of the rearmost first metal strip 5 is located on the same plane as the rear end face of the dielectric substrate 4; the center distance between every two adjacent first metal strips 5 is 0.1λ, λ=c/f, c is the wave velocity and meets: c=3*10^8 m/s, and f is the center operating frequency of the broadband panel array antenna; the second metal layer includes M second metal strips 6 attached to the upper surface of the dielectric substrate 4, each second metal strip 6 is in an isosceles trapezoid shape, a connecting line between the midpoint of an upper line and the midpoint of a lower line of each second metal strip 6 is located on a vertical plane where a diagonal line of the upper surface of the dielectric substrate 4 is located, planes where two legs of each second metal strip 6 are located overlap with planes where two adjacent end faces of the dielectric substrate 4 are located, and the M first metal strips 5 are in one-to-one correspondence with the M second metal strips 6; and regarding the first metal strips 5 and the second metal strips 6 corresponding to the first metal strips 5, if the first metal strips 5 are mapped onto the upper surface of the dielectric substrate 4 and are then anticlockwise rotated by 45°, the front end faces of the first metal strips 5 overlap with the upper lines of the second metal strips 6, and the rear end faces of the first metal strips 5 overlap with the lower lines of the second metal strips 6.

Figure 4:
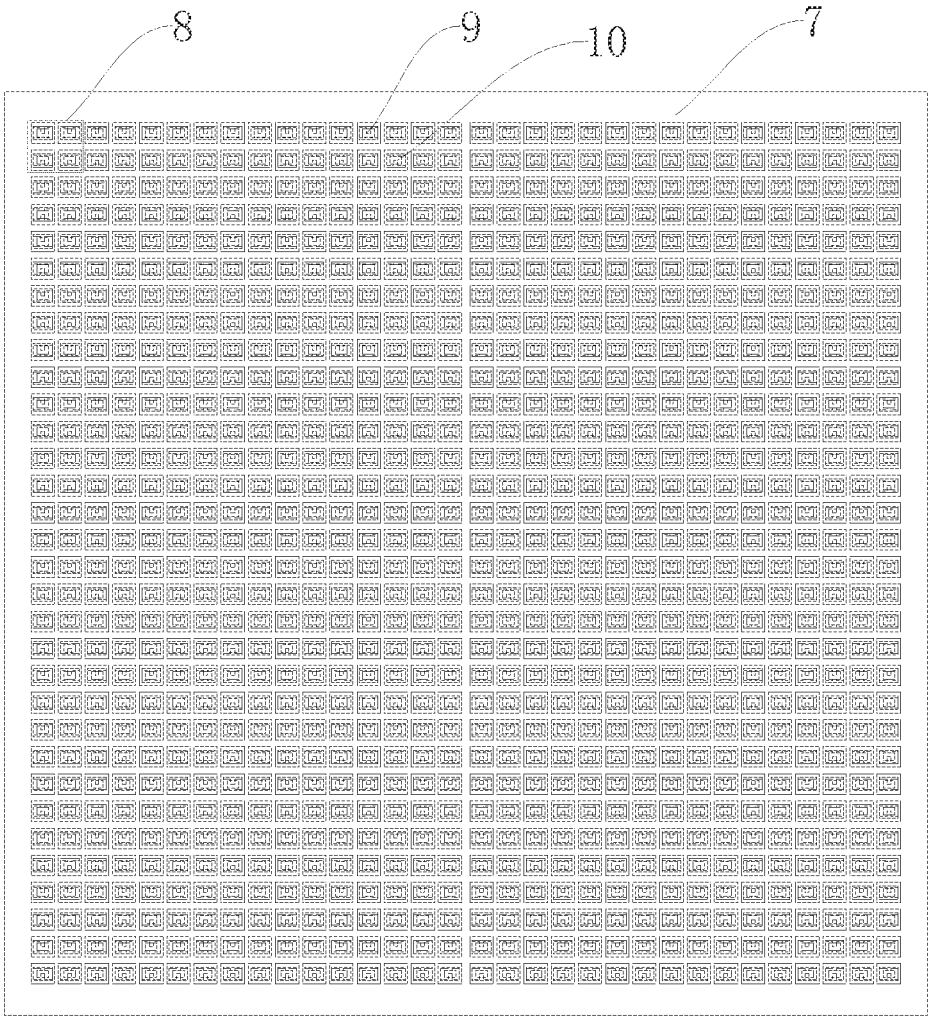
FIG. 4 is a top view of a radiating layer of the broadband panel array antenna of the invention.
Figure 5:
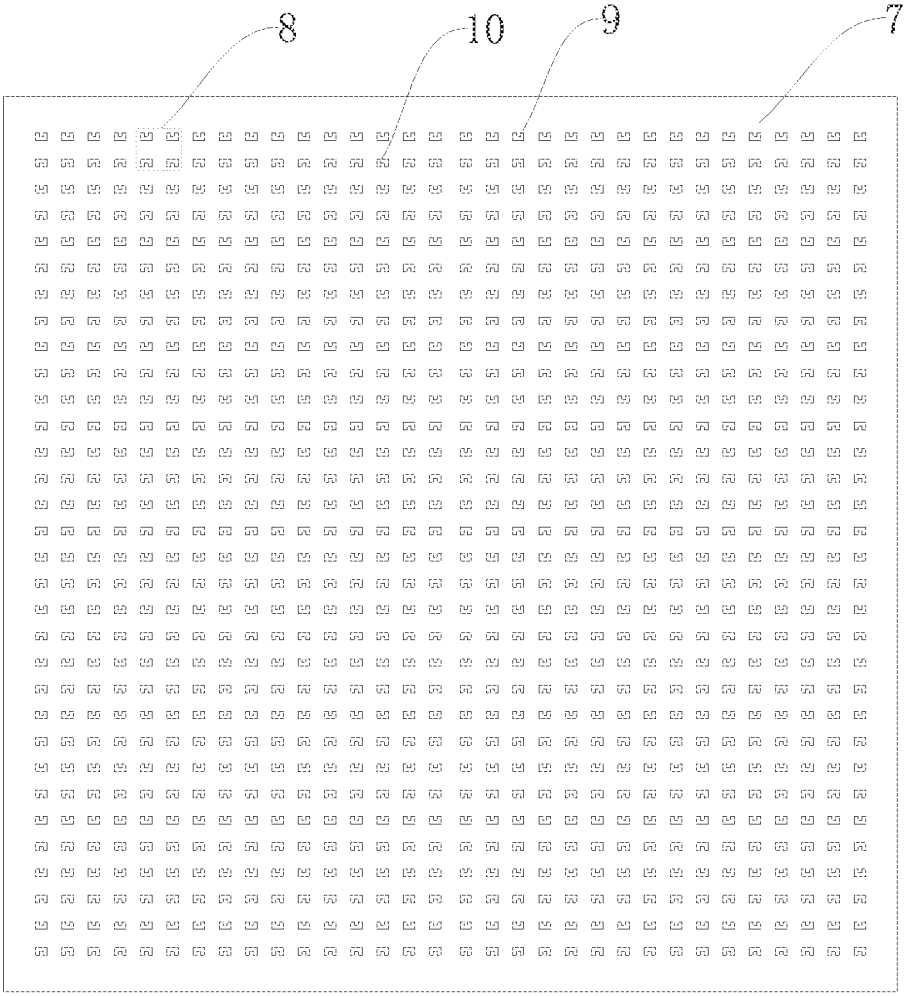
FIG. 5 is a bottom view of the radiating layer of the broadband panel array antenna of the invention.
Figure 6:
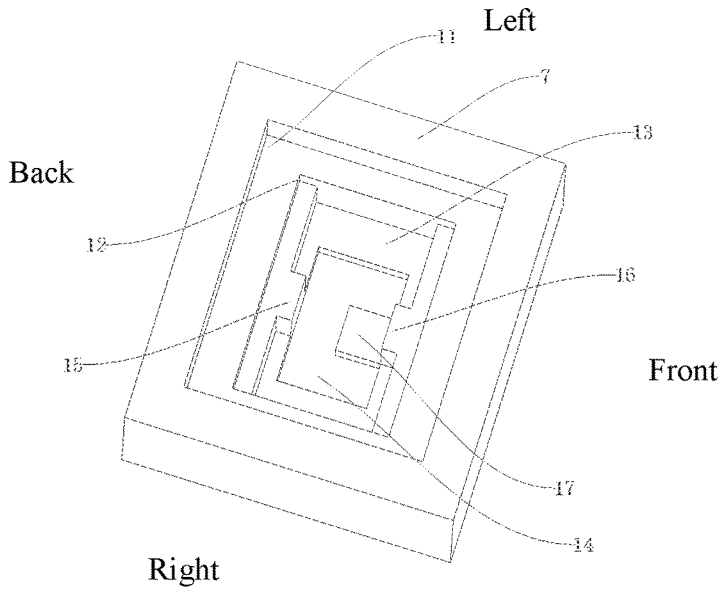
FIG. 6 is a perspective view of a first radiating element of the radiating layer of the broadband panel array antenna of the invention.

In this embodiment, as shown in FIG. 4-FIG. 6, the radiating layer 2 includes a first panel 7 and a radiating array disposed on the first panel 7, wherein the first panel 7 is rectangular, the radiating array is formed by $n^2$ radiating units 8 which are distributed in $2^{(k-1)}$ rows and $2^{(k-1)}$ columns, $n=2^{(k-1)}$, k is an integer which is greater than or equal to 3, the center distance between every two adjacent radiating units 8 in the same row is 1.8λ, and the center distance between every two adjacent radiating units 8 in the same column is 1.8λ; the radiating unit 8 includes two first radiating elements 9 and two second radiating elements 10, wherein the two first radiating elements 9 are parallelly arranged left and right in a spaced manner, the first radiating element 9 on the left overlaps with the first radiating element 9 on the right after being moved rightwards by 0.9λ, the two second radiating elements 10 are arranged left and right in a spaced manner, the second radiating element 10 on the left overlaps with the second radiating element 10 on the right after being moved rightwards by 0.9λ, the two second radiating elements 10 are located behind the two first radiating elements 9, the center distance between the second radiating element 10 on the left and the first radiating element 10 on the left is 0.9λ, the second radiating element 10 on the left and the first radiating element 9 on the left are symmetrical front and back, the center distance between the second radiating element 10 on the right and the first radiating element 9 on the right is 0.9λ, and the second radiating element 10 on the right and the first radiating element 9 on the right are symmetrical front and back; the first radiating element 9 includes a first rectangular cavity 11, a second rectangular cavity 12, a third rectangular cavity 13, a fourth rectangular cavity 14, a first rectangular matching board 15, a second rectangular matching board 16 and a third rectangular matching board 17, wherein the first rectangular cavity 11, the second rectangular cavity 12, the third rectangular cavity 13 and the fourth rectangular cavity 14 are formed in the first panel 7 and are sequentially stacked and communicated from top to bottom, the center of the first rectangular cavity 11, the center of the second rectangular cavity 12, the center of the third rectangular cavity 13 and the center of the fourth rectangular cavity 14 are located on the same straight line, the front end face of the first rectangular cavity 11, the front end face of the second rectangular cavity 12, the front end face of the third rectangular cavity 13 and the front end face of the fourth rectangular cavity 14 are parallel to the front end face of the first panel 7, the upper end face of the first rectangular cavity 11 is located on the same plane as the upper end face of the first panel 7, the upper end face of the second rectangular cavity 12 is located on the same plane as the lower end face of the first rectangular cavity 11, the upper end face of the third rectangular cavity 13 is located on the same plane as the lower end face of the second rectangular cavity 12, the upper end face of the fourth rectangular cavity 14 is located on the same plane as the lower end face of the third rectangular cavity 13, the lower end face of the fourth rectangular cavity 14 is located on the same plane as the lower end face of the first panel 7, the left-right length of the first rectangular cavity 11 is 0.8λ, the front-back length of the first rectangular cavity 11 is 0.7λ, the height of the first rectangular cavity 11 is 0.25λ, the left-right length of the second rectangular cavity 12 is 0.6λ, the front-back length of the second rectangular cavity 12 is 0.5λ, the height of the second rectangular cavity 12 is 0.125λ, the left-right length of the third rectangular cavity 13 is 0.6λ, the front-back length of the third rectangular cavity 13 is less than 0.5λ, the height of the third rectangular cavity 13 is 0.25λ, the left-right length of the fourth rectangular cavity 14 is half that of the first rectangular cavity 11, the front-back length of the fourth rectangular cavity 14 is two fifths that of the first rectangular cavity 11, the first rectangular matching board 15 and the second rectangular matching board 16 are located in the third rectangular cavity 13, the rear wall of the first rectangular matching board 15 is attached and integrally connected to the rear wall of the third rectangular cavity 13, the distance from the left end face of the first rectangular matching board 15 to the left end face of the third rectangular cavity 13 is equal to the distance from the right end face of the first rectangular matching board 15 to the right end face of the third rectangular cavity 13, the left-right length of the first rectangular matching board 15 is a quarter that of the third rectangular cavity 13, the front-back length of the first rectangular matching board 15 is one-tenth that of the third rectangular cavity 13, the upper end face of the first rectangular matching board 15 is located on the same plane as the upper end face of the third rectangular cavity 13, the lower end face of the first rectangular matching board 15 is located on the same plane as the lower end face of the third rectangular cavity 13, the second rectangular matching board 16 and the first rectangular matching board 15 are symmetrical front and back with respect to a front-back bisection plane of the third rectangular cavity 13, the third rectangular matching board 17 is located in the fourth rectangular cavity 14, the front wall of the third rectangular matching board 17 is attached and integrally connected to the front wall of the fourth rectangular cavity 14, the distance from the left end face of the third rectangular matching board 17 to the left end face of the fourth rectangular cavity 14 is equal to the distance from the right end face of the third rectangular matching board 17 to the right end face of the fourth rectangular cavity 14, the upper end face of the third rectangular matching board 17 is located on the same plane as the upper end face of the fourth rectangular cavity 14, the lower end face of the third rectangular matching board 17 is located on the same plane as the lower end face of the fourth rectangular cavity 14, the left-right length of the third rectangular matching board 17 is three tenths that of the fourth rectangular cavity 14, the front-back length of the third rectangular matching board 17 is half that of the fourth rectangular cavity 14, and the lower end face of the fourth rectangular cavity 14 is used as an input terminal of the first radiating element 9; the input terminals of the two first radiating elements 9 and input terminals of the two second radiating elements 10 are used as fourth input terminals of the radiating unit, the four input terminals of each radiating unit 8 are used as four input terminals of the radiating layer 2, the radiating layer 2 has $4*n^2$ input terminals, the upper end face of the first rectangular cavity 11 is used as an output terminal of the first radiating element 9, the output terminals of the two first radiating elements 9 and output terminals of the two second radiating elements 10 are used as four output terminals of the radiating unit 8, the four output terminals of each radiating unit 8 are used as four output terminals of the radiating layer 2, the radiating layer 2 has $4*n^2$ output terminals, $4*n^2$ paths of TE10 mode signals output by the feed layer 3 are accessed to the $4*n^2$ input terminals of the radiating layer 2 in a one-to-one corresponding manner, and the $4*n^2$ output terminals of the radiating layer 2 are used for radiating the $4*n^2$ paths of TE10 mode signals output by the feed layer 3 to the free space in a one-to-one corresponding manner.

Figure 7:
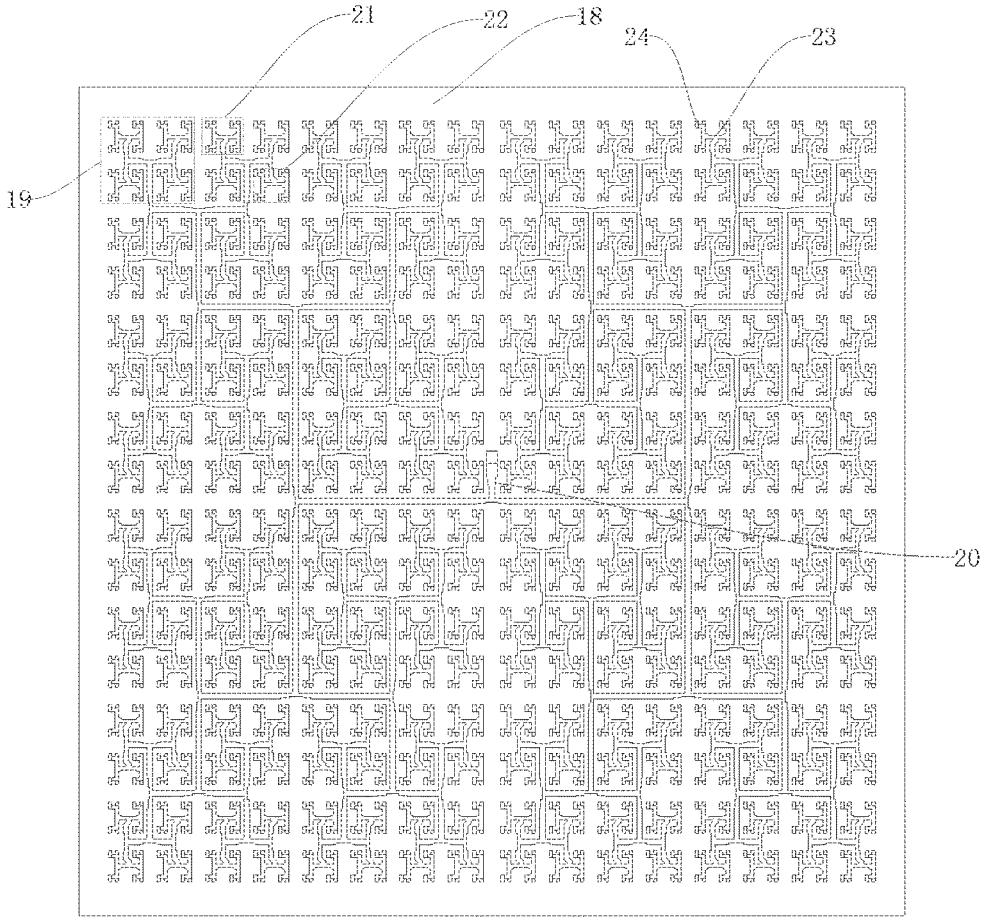
FIG. 7 is a top view of a feed layer of the broadband panel array antenna of the invention.
Figure 8:
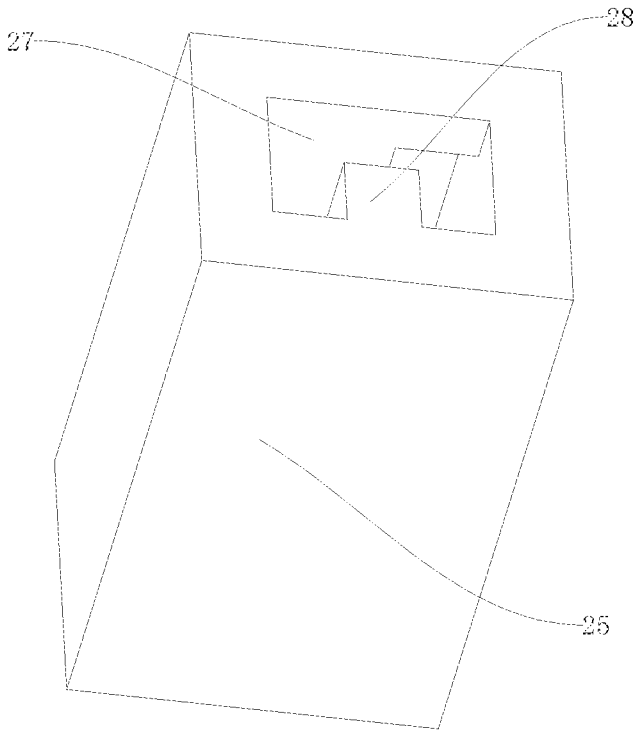
FIG. 8 is a perspective view of an E-plane rectangular waveguide-single ridge waveguide converter of the feed layer of the broadband panel array antenna of the invention.
Figure 9:
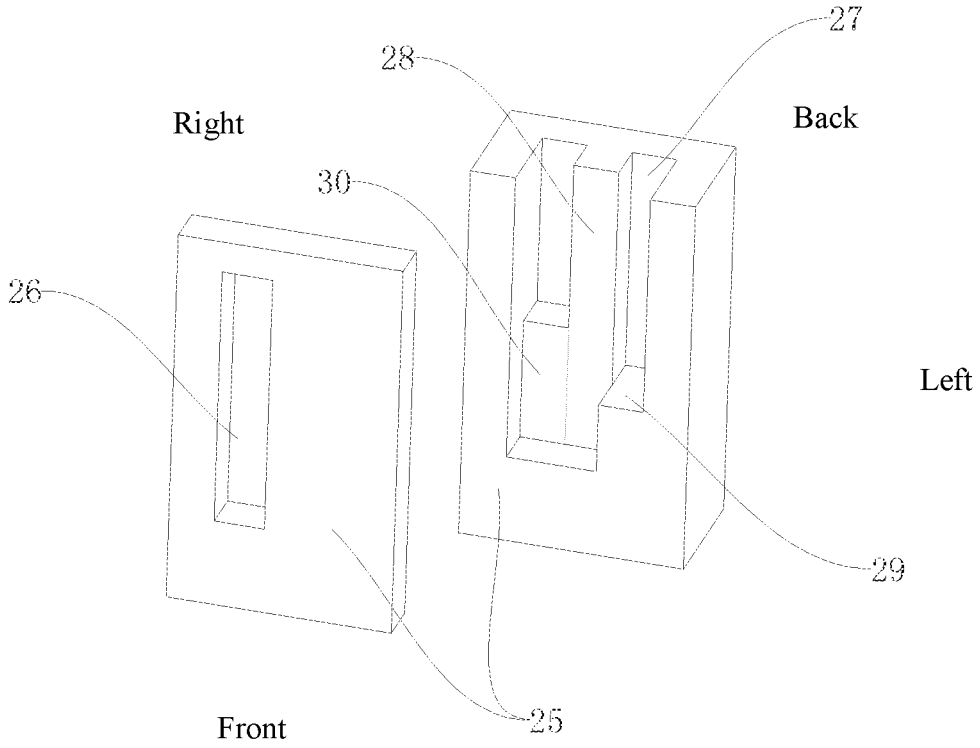
FIG. 9 is a first exploded view of the E-plane rectangular waveguide-single ridge waveguide converter of the feed layer of the broadband panel array antenna of the invention.
Figure 10:
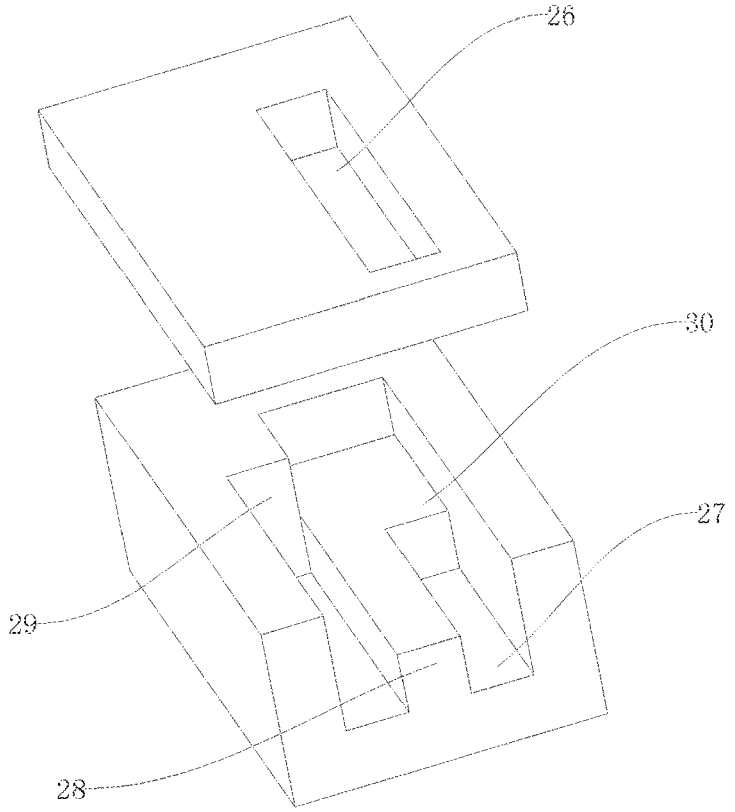
FIG. 10 is a second exploded view of the E-plane rectangular waveguide-single ridge waveguide converter of the feed layer of the broadband panel array antenna of the invention.
Figure 11:
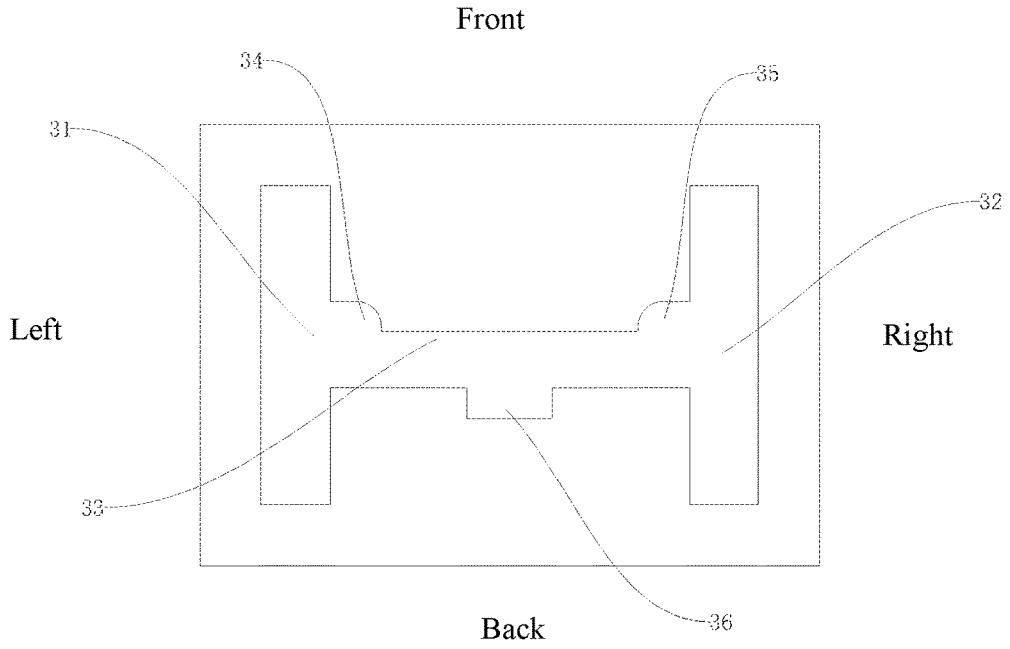
FIG. 11 is a top view of a first-stage H-type E-plane waveguide power divider of the feed layer of the broadband panel array antenna of the invention.
Figure 12:
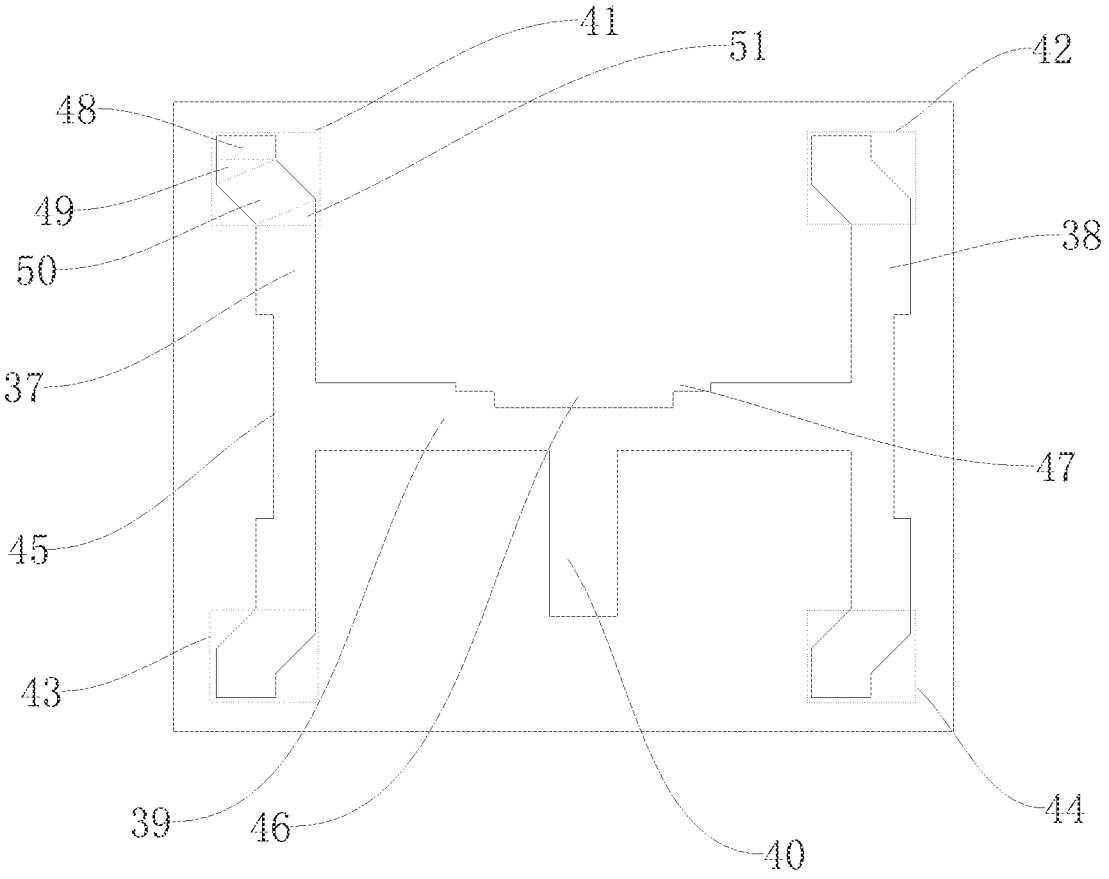
FIG. 12 is a top view of a second-stage H-type E-plane waveguide power divider of the feed layer of the broadband panel array antenna of the invention.

In this embodiment, as shown in FIG. 7, the feed layer 3 includes a second panel 18, and $$\left(\frac{n}{2^1}\right)^2$$

first-stage H-type E-plane waveguide power dividing network units 19 and a standard waveguide input port disposed on the second panel 18, wherein the second panel 18 is rectangular; each first-stage H-type E-plane waveguide power dividing network unit 19 includes a first-stage H-type E-plane waveguide power dividing network and a second-stage H-type E-plane waveguide power divider, wherein the second-stage H-type E-plane waveguide power divider has an input terminal and four output terminals and is used for dividing one path of signals input to the input terminal thereof into four paths of same-power in-phase signals, which are then respectively output by the output terminals thereof, the input terminal of the second-stage H-type E-plane waveguide power divider is used as an input terminal of the first-stage H-type E-plane waveguide power dividing network unit 19, the first-stage H-type E-plane waveguide power dividing network includes two first H-type E-plane waveguide power dividing networks 21 and two second H-type E-plane waveguide power dividing networks 22, the two first H-type E-plane waveguide power dividing networks 21 are parallelly arranged left and right in a spaced manner, the first H-type E-plane waveguide power dividing network 21 on the left overlaps with the first H-type E-plane waveguide power dividing network 21 on the right after being moved rightwards by 1.8λ, the two second H-type E-plane waveguide power dividing networks 22 are arranged left and right in a spaced manner, the second H-type E-plane waveguide power dividing network 22 on the left overlaps with the second H-type E-plane waveguide power dividing network 22 on the right after being moved rightwards by 1.8λ, the two second H-type E-plane waveguide power dividing networks 22 are located behind the two first H-type E-plane waveguide power dividing networks 21, the center distance between the second H-type E-plane waveguide power dividing network 22 on the left and the first H-type E-plane waveguide power dividing network 21 on the left is 1.8λ, the second H-type E-plane waveguide power dividing network 22 on the left and the first H-type E-plane waveguide power dividing network 21 on the left are symmetrical front and back, the center distance between the second H-type E-plane waveguide power dividing network 22 on the right and the first H-type E-plane waveguide power dividing network 21 on the right is 1.8λ, and the second H-type E-plane waveguide power dividing network 22 on the right and the first H-type E-plane waveguide power dividing network 21 on the right are symmetrical front and back; the first H-type E-plane waveguide power dividing network 21 includes a first-stage H-type E-plane waveguide power divider 23 and four E-plane rectangular waveguide-single ridge waveguide converters 24, wherein the first-stage H-type E-plane waveguide power divider 23 has an input terminal and four output terminals and divides one path of signals input to the input terminal thereof into four paths of same-power in-phase signals, which are then respectively output by the four output terminals thereof, each E-plane rectangular waveguide-single ridge waveguide converter 24 has an input terminal and an output terminal and is used for converting a rectangular waveguide accessed to the input terminal thereof into a single ridge waveguide, which is then output by the output terminal thereof, the input terminals of the four E-plane rectangular waveguide-single ridge waveguide converters 24 are connected to the four output terminals of the first-stage H-type E-plane waveguide power divider 23 in a one-to-one corresponding manner, the output terminal of each E-plane rectangular waveguide-single ridge waveguide converter 24 is used as an output terminal of the first H-type E-plane waveguide power dividing network 21, the first H-type E-plane waveguide power dividing network 21 has four output terminals, the four output terminals of each of the two first H-type E-plane waveguide power dividing networks 21 and four output terminals of each of the two second H-type E-plane waveguide power dividing networks 22 are used as the output terminals of the first-stage H-type E-plane waveguide power dividing network unit 19, each first-stage H-type E-plane waveguide power dividing network unit 19 has sixteen output terminals, the $$\left(\frac{n}{2^1}\right)^2$$

first-stage H-type E-plane waveguide power dividing network units 19 has $$16*\left(\frac{n}{2^1}\right)^2$$

output terminals, and the $$16*\left(\frac{n}{2^1}\right)^2$$

output terminals of the $$\left(\frac{n}{2^1}\right)^2$$

first-stage H-type E-plane waveguide power dividing network units 19 are used as $$16*\left(\frac{n}{2^1}\right)^2$$

output terminals of the feed layer 3 and are connected to the $4n^2$ input terminals of the radiating layer 2 in a one-to-one corresponding manner; the $$\left(\frac{n}{2^1}\right)^2$$

first-stage H-type E-plane waveguide power dividing network units 19 are uniformly distributed in $$\frac{n}{2^1}$$

rows and $$\frac{n}{2^1}$$

columns at intervals to form a first-stage feed network array, the center distance between every two adjacent first-stage H-type E-plane waveguide power dividing network units 19 in the same row is 3.6λ, and the center distance between every two adjacent first-stage H-type E-plane waveguide power dividing network units 19 in the same column is 3.6λ; from the first row and the first column of the first-stage feed network array, the four first-stage H-type E-plane waveguide power dividing network units 19 in every two rows and columns constitute a first-stage network unit group, the first-stage feed network array includes $$\left(\frac{n}{2^2}\right)^2$$

first-stage network unit groups in total, each first-stage network unit group includes a third-stage H-type E-plane waveguide power divider which has an input terminal and four output terminals and is used for dividing one path of signals input to the input terminal thereof into four paths of same-power in-phase signals, which are then output by the four output terminals thereof, the four output terminals of the third-stage H-type E-plane waveguide power divider are connected to the input terminals of the four first-stage H-type E-plane waveguide power dividing network units 19 in the first-stage network unit group in a one-to-one corresponding manner, each first-stage network unit group and the third-stage H-type E-plane waveguide power divider connected to the first-stage network unit group constitute a second-stage H-type E-plane waveguide power dividing network unit, the input terminal of the third-stage H-type E-plane waveguide power divider is used as an input terminal of the second-stage H-type E-plane waveguide power dividing network unit, and $$\left(\frac{n}{2^2}\right)^2$$

second-stage H-type E-plane waveguide power dividing network units which are distributed in $$\frac{n}{2^2}$$

rows and $$\frac{n}{2^2}$$

columns are obtained in total and constitute a second-stage feed network array; from the first row and the first column of the second-stage feed network array, the four second-stage H-type E-plane waveguide power dividing network unit in every two rows and columns constitute a second-stage network unit group, the second-stage feed network array includes $$\left(\frac{n}{2^3}\right)^2$$

second-stage network unit groups, the input terminal of the third-stage H-type E-plane waveguide power divider of each second-stage H-type E-plane waveguide power dividing network unit in the second-stage network unit group is used as an input terminal of the second-stage network unit group, and the second-stage network unit group has four input terminals; each second-stage network unit group includes a fourth-stage H-type E-plane waveguide power divider which has an input terminal and four output terminals and is used for dividing one path of signals input to the input terminal thereof into four paths of same-power in-phase signals, which are then respectively output by the four output terminals thereof, and the four output terminals of the fourth-stage H-type E-plane waveguide power divider are connected to the four input terminal of the second-stage network unit group in a one-to-one corresponding manner; each second-stage network unit group and the fourth-stage H-type E-plane waveguide power divider connected to the second-stage network unit group constitute a third-stage H-type E-plane waveguide power dividing network unit, the input terminal of the fourth-stage H-type E-plane waveguide power divider is used as an input terminal of the third-stage H-type E-plane waveguide power dividing network unit, and $$\left(\frac{n}{2^3}\right)^2$$

third-stage H-type E-plane waveguide power dividing network units which are distributed in $$\frac{n}{2^3}$$

rows and $$\frac{n}{2^3}$$

columns are obtained in total and constitute a third-stage feed network array; by analogy, $$\left(\frac{n}{2^{k-2}}\right)^2$$

(k-2)th-stage H-type E-plane waveguide power dividing network units constitute a (k-2)th feed network array, a (k-1)th-stage H-type E-plane waveguide power divider is arranged among the four (k-2)th-stage H-type E-plane waveguide power dividing network units in the (k-2)th feed network array, has an input terminal and four output terminals, and is used for dividing one path of signals input to the input terminal thereof into four paths of same-power in-phase signals, which are then respectively output by the four output terminals thereof, the four output terminals of the (k-1)th-stage H-type E-plane waveguide power divider are connected to the input terminals of the four (k-2)th-stage H-type E-plane waveguide power dividing network units in a one-to-one corresponding manner, the input terminal of the (k-1)th-stage H-type E-plane waveguide power divider is connected to the standard waveguide input port 20, the standard waveguide input port 20 is used as an input terminal of the feed layer 3, and the input terminal of the feed layer 3 is connected to an external signal port.

In this embodiment, as shown in FIG. 8-FIG. 12, the E-plane rectangular waveguide-single ridge converter 24 includes a first rectangular metal block 25, wherein a rectangular port 26 and a fifth rectangular cavity 27 are formed in the first rectangular metal block 25, the rectangular port 26 is the input terminal of the E-plane rectangular waveguide-single ridge converter 24, the upper end face of the rectangular port 26 is a certain distance away from the upper end face of the first rectangular metal block 25, the front end face of the rectangular port 26 is located on the same plane as the front end face of the first rectangular metal block 25, the upper end face of the fifth rectangular cavity 27 is located on the same plane as the upper end face of the first rectangular metal block 25, the right end face of the fifth rectangular cavity 27 is located on the same plane as the right end face of the rectangular port 26, the front end face of the fifth rectangular cavity 27 is connected and attached to the rear end face of the rectangular port 26, the lower end face of the fifth rectangular cavity 27 is located on the same plane as the lower end face of the rectangular port 26, a plane where the left end face of the rectangular port 26 is located is a certain distance away from a plane where the left end face of the fifth rectangular cavity 27 is located, the left end face of the fifth rectangular cavity 27 is a certain distance away from the left end face of the first rectangular metal block 25, the distance from the left end face of the fifth rectangular cavity 27 to the left end face of the first rectangular metal block 25 is equal to the distance from the right end face of the fifth rectangular cavity 27 to the right end face of the first rectangular metal block 25, the lower end face of the fifth rectangular cavity 27 is a certain distance away from the lower end face of the first rectangular metal block 25, a single-ridge step 28, an E-plane step 29 and an H-plane step 30 are disposed in the fifth rectangular cavity 27 and are all rectangular blocks, the right end face of the H-plane step 30 is connected and attached to the right end face of the fifth rectangular cavity 27, the lower end face of the H-plane step 30 is connected and attached to the lower end face of the fifth rectangular cavity 27, the left end face of the H-plane step 30 is connected and attached to the right end face of the single-ridge step 28, the lower end face of the single-ridge step 28 is connected and attached to the lower end face of the fifth rectangular cavity 27, the upper end face of the single-ridge step 28 is located on the same plane as the upper end face of the fifth rectangular cavity 27, the left end face of the single-ridge step 28 is connected and attached to the right end face of the E-plane step 29, the left end face of the E-plane step 29 is connected and attached to the left end face of the fifth rectangular cavity 27, and the lower end face of the E-plane step 29 is connected and attached to the lower end face of the fifth rectangular cavity 27; the front-back length of the H-plane step 30 is half that of the fifth rectangular cavity 27, the left-right length of the H-plane step 30 is one third that of the fifth rectangular cavity 27, the vertical length of the H-plane step 30 is two fifths that of the fifth rectangular cavity 27, the front-back length of the single-ridge step 28 is half that of the fifth rectangular cavity 27, the left-right length of the single-ridge step 28 is one third that of the fifth rectangular cavity 27, the vertical length of the single-ridge step 28 is equal to that of the fifth rectangular cavity 27, the front-back length of the E-plane step 29 is equal to that of the fifth rectangular cavity 27, the left-right length of the E-plane step 29 is one third that of the fifth rectangular cavity 27, the vertical length of the E-plane step 29 is a quarter that of the fifth rectangular cavity 27, and the upper end face of the fifth rectangular cavity 27 is the output terminal of the E-plane rectangular waveguide-single ridge converter 24; the first-stage H-type E-plane waveguide power divider 23 includes a first rectangular block 31, a second rectangular block 32, a third rectangular block 33, a first matching block 34, a second matching block 35 and a fourth rectangular block 36, wherein the upper end face of the first rectangular block 31, the upper end face of the second rectangular block 32, the upper end face of the third rectangular block 33, the upper end face of the first matching block 34, the upper end face of the second matching block 35 and the upper end face of the fourth matching block 36 are located on the same plane, the left end face of the first rectangular block 31 is parallel to the left end face of the second panel 18, the front-back length of the first rectangular block 31 is 0.7λ, the left-right length of the first rectangular block 31 is 0.125λ, the vertical length of the first rectangular block 31 is 0.8λ, the left end face of the third rectangular block 33 is connected and attached to the right end face of the first rectangular block 31, the front-back length of the third rectangular block 33 is 0.125λ, the left-right length of the third rectangular block 33 is 0.9λ, the vertical length of the third rectangular block 33 is 0.8λ, the distance from a plane where the front end face of the third rectangular block 33 is located to a plane where the front end face of the first rectangular block 31 is located is equal to the distance from a plane where the rear end face of the third rectangular block 33 is located to a plane where the rear end face of the first rectangular block 31 is located, the right end face of the third rectangular block 33 is connected and attached to the left end face of the second rectangular block 32, the front-back length of the second rectangular block 32 is 0.7λ, the left-right length of the second rectangular block 32 is 0.125λ, the vertical length of the second rectangular block 32 is 0.8λ, the distance from a plane where the front end face of the third rectangular block 33 is located to a plane where the front end face of the second rectangular block 32 is located is equal to the distance from a plane where the rear end face of the third rectangular block 33 is located to a plane where the rear end face of the second rectangular block 32 is located, the first matching block 34 is a rectangular block, the left end face of the first matching block 34 is connected and attached to the right end face of the first rectangular block 31, the rear end face of the first matching block 34 is connected and attached to the front end face of the third rectangular block 33, the front-back length of the first matching block 34 is one-tenth that of the first rectangular block 31, the left-right length of the first matching block 34 is four fifths that of the first rectangular block 31, the vertical length of the first matching block 34 is 0.8λ, the second matching block 35 and the first matching block 34 are symmetrical left and right with respect to a front-back midline of the third rectangular block 33, the front end face of the fourth rectangular block 36 is connected and attached to the rear end face of the third rectangular block 33, the distance from the left end face of the fourth rectangular block 36 to the right end face of the first rectangular block 31 is equal to the distance from the right end face of the fourth rectangular block 36 to the left end face of the second rectangular block 32, the left-right length of the fourth rectangular block 36 is 1.25 times that of the first rectangular block 31, the vertical length of the fourth rectangular block 36 is 0.8λ, and the front end face of the first rectangular block 31, the rear end face of the first rectangular block 31, the front end face of the second rectangular block 32 and the rear end face of the second rectangular block 32 are used as the four output terminals of the first-stage H-type E-plane waveguide power divider 23 respectively; the second-stage H-type E-plane waveguide power divider includes a fifth rectangular block 37, a sixth rectangular block 38, a seventh rectangular block 39, an eighth rectangular block 40, a first conversion block 41, a second conversion block 42, a third conversion block 43 and a fourth conversion block 44, wherein the upper end face of the fifth rectangular block 37, the upper end face of the sixth rectangular block 38, the upper end face of the seventh rectangular block 39, the upper end face of the first conversion block 41, the upper end face of the second conversion block 42, the upper end face of the third conversion block 43, the upper end face of the fourth conversion block 44 and the upper end face of the eighth rectangular block 40 are located on the same plane, the front-back length of the fifth rectangular block 37 is 1.2λ, the left-right length of the fifth rectangular block 37 is 0.125λ, the vertical length of the fifth rectangular block 37 is 0.8λ, a first rectangular recess 45 is formed in the left end face of the fifth rectangular block 37, the vertical length of the first rectangular recess 45 is equal to that of the fifth rectangular block 37, the front-back length of the first rectangular recess 45 is smaller than that of the fifth rectangular cavity 37, the left-right length of the first rectangular recess 35 is smaller than that of the fifth rectangular cavity 37, the distance from a plane where the front end face of the first rectangular recess 45 is located to a plane where the front end face of the fifth rectangular block 37 is located is equal to the distance from a plane where the rear end face of the first rectangular recess 45 to a plane where the rear end face of the fifth rectangular block 37 is located, the sixth rectangular block 38 and the fifth rectangular block 37 are symmetrical left and right, the center distance between the sixth rectangular block 38 and the fifth rectangular block 37 is 1.9λ, the left end face of the seventh rectangular block 39 is connected and attached to the right end face of the fifth rectangular block 37, the right end face of the seventh rectangular block 39 is connected and attached to the left end face of the sixth rectangular block 38, the front-back length of the seventh rectangular block 39 is 0.2λ, the left-right length of the seventh rectangular block 39 is 1.9λ, the vertical length of the seventh rectangular block 39 is 0.8λ, the distance from a plane where the front end face of the seventh rectangular block 39 is located to a plane where the front end face of the fifth rectangular block 37 is located is equal to the distance from a plane where the rear end face of the seventh rectangular block 39 is located to a plane where the rear end face of the fifth rectangular block 37 is located, a stepped recess is formed in the front end face of the seventh rectangular cavity 39 and includes a second rectangular recess 46 and a third rectangular recess 47 which are communicated with each other, the vertical length of the second rectangular recess 46 and the third rectangular recess 47 is equal to that of the seventh rectangular block 39, the left-right length of the second rectangular recess 46 is smaller than that of the third rectangular recess 47, the left-right length of the third rectangular recess 47 is smaller than that of the seventh rectangular block 39, the front-back length of the second rectangular recess 46 is smaller than that of the third rectangular recess 47, the sum of the front-back length of the second rectangular recess 46 and the front-back length of the third rectangular recess 47 is smaller than the front-back length of the seventh rectangular block 39, the front end face of the third rectangular recess 47 is located on the same plane as the front end face of the seventh rectangular block 39, the rear end face of the third rectangular recess 47 is connected and attached to the front end face of the second rectangular recess 46, the distance from the left end face of the third rectangular recess 47 to the left end face of the seventh rectangular block 39 is equal to the distance from the right end face of the third rectangular recess 47 to the right end face of the seventh rectangular block 39, and the distance from the left end face of the second rectangular recess 46 to the left end face of the seventh rectangular block 39 is equal to the distance from the right end face of the second rectangular recess 46 to the right end face of the seventh rectangular block 39; the left-right length of the eighth rectangular block 40 is 1.1 times that of the fifth rectangular block 37, the front end face of the eighth rectangular block 40 is connected and attached to the rear end face of the seventh rectangular block 39, the distance from the left end face of the eighth rectangular block 40 to the right end face of the fifth rectangular block 37 is equal to the distance from the right end face of the eighth rectangular block 40 to the left end face of the sixth rectangular block 38, the vertical length of the eighth rectangular block 40 is 0.8λ, the front-back length of the eighth rectangular block 40 is 0.2λ, the left-right length of the eighth rectangular block 40 is 0.2λ, and the rear end face of the eighth rectangular block 40 is the input terminal of the second-stage H-type E-plane waveguide power divider; the first conversion block 41 consists of a ninth rectangular block 48, a first right-angle triangular block 49, a second right-angle triangular block 50 and a parallelogram block 51, wherein the ninth rectangular block 48, the first right-angle triangular block 49, the second right-angle triangular block 50 and the parallelogram block 51 are located on the same plane, the front end face of the ninth rectangular block 48 is the front end face of the first conversion block 41, the left-right length of the ninth rectangular block 48 is equal to 0.2λ, the vertical length of the ninth rectangular block 48 is equal to 0.8λ, the end face where a first right-angle side of the first right-angle triangular block 49 is located is connected and attached to the rear end face of the ninth rectangular block 48, the length of the end face where the first right-angle side of the first right-angle triangular block is located is equal to the left-right length of the ninth rectangular block 48, the end face, where a second right-angle side of the first right-angle triangular block is located, is located on the same plane as the left end face of the ninth rectangular block 48, the vertical length of the first right-angle triangular block is equal to that of the ninth rectangular block 48, the end face where a first right-angle side of the second right-angle triangular block is located is connected and attached to the front end face of the fifth rectangular block 37, the end face, where a second right-angle side of the second right-angle triangular block is located, is located on the same plane as the right end face of the fifth rectangular block 37, the length of the end face where the first right-angle side of the second right-angle triangular block is located is equal to the left-right length of the fifth rectangular block 37, the vertical length of the second right-angle triangular block is equal to that of the fifth rectangular block 37, the front end face of the parallelogram block 51 completely overlaps with the end face where a hypotenuse of the second right-angle second triangular block is located, the distance between the front end face and the rear end face of the parallelogram block 51 is 0.2λ, the vertical length of the parallelogram block 51 is equal to that of the second right-angle triangular block, an angle between the end face where the first right-angle side of the first right-angle triangular block is located and the end face where a hypotenuse of the first right-angle second triangular block is located is 22.5°, and an angle between the end face where the first right-angle side of the second right-angle triangular block is located and the end face where the hypotenuse of the second right-angle second triangular block is located is 22.5°; the second conversion block 42 and the first conversion block 41 are symmetrical left and right, the third conversion block 43 overlaps with the second conversion block 42 after being moved rightward by 1.9λ, the third conversion block 43 and the first conversion block 41 are symmetrical front and back, the center distance between the third conversion block 43 and the first conversion block 41 is 1.2λ, the fourth conversion block 44 and the second conversion block 42 are symmetrical front and back, and the front end face of the first conversion block 41, the front end face of the second conversion block 42, the front end face of the third conversion block 43 and the front end face of the fourth conversion block 44 are used as the four output terminals of the second-stage H-type E-plane waveguide power divider; the hth-stage H-type E-plane waveguide power divider is identical in structure with the second-stage H-type E-plane waveguide power divider, but the size is increased gradually, and h=3, 4, . . . , k-1; when the four output terminals of each first-stage H-type E-plane waveguide power divider are connected to the input terminals of four E-plane rectangular waveguide-single ridge waveguide converters 24 in a one-to-one corresponding manner, each output terminal of the first-stage H-type E-plane waveguide power divider is attached to and completely overlaps with the input terminal of one E-plane rectangular waveguide-single ridge waveguide converter 24; when the four output terminals of each second-stage H-type E-plane waveguide power divider are connected to the input terminals of four first-stage H-type E-plane waveguide power dividers 23 in a one-to-one corresponding manner, each output terminal of the second-stage H-type E-plane waveguide power divider is attached to and completely overlaps with the input terminal of one first-stage H-type E-plane waveguide power divider 23; and when the four output terminals of the hth-stage H-type E-plane waveguide power divider are connected to the input terminals of four (h-1)th-stage H-type E-plane waveguide power dividers in a one-to-one corresponding manner, each output terminal of the hth-stage H-type E-plane waveguide power divider is attached to and completely overlaps with the input terminal of one (h-1)th-stage H-type E-plane waveguide power divider.

What is claimed is:

1. A broadband panel array antenna comprising a polarization layer, a radiating layer and a feed layer which are sequentially stacked from top to bottom, wherein the feed layer is used for converting a single path of TE10 mode signals into a plurality of paths of same-power in-phase TE10 mode signals and transmitting the plurality of paths of TE10 mode signals to the radiating layer, the radiating layer is used for radiating the plurality of paths of TE10 mode signals from the feed layer to a free space, and the polarization layer is used for rotating a polarization direction of an electric field generated by the radiating layer to reduce a side lobe in an E-plane direction diagram and an H-plane direction diagram.

2. The broadband panel array antenna according to claim 1, wherein the polarization layer comprises a dielectric substrate, a first metal layer disposed on a lower surface of the dielectric substrate, and a second metal layer disposed on an upper surface of the dielectric substrate, the dielectric substrate is made of plastic and is of a rectangular structure, a lengthwise direction of the dielectric substrate is defined as a left-right direction, and a widthwise direction of the dielectric substrate is defined as a front-back direction; the first metal layer comprises M first metal strips attached to the lower surface of the dielectric substrate, M is an integer which is greater than or equal to 2, each of the first metal strips is of a rectangular structure, the M first metal strips are identical in size and are regularly disposed at intervals from front to back, a left end face of each of the first metal strips is located on the same plane as a left end face of the dielectric substrate, a right end face of each of the first metal strips is located on the same plane as a right end face of the dielectric substrate, a front end face of a foremost first metal strip of the first metal strips is located on the same plane as a front end face of the dielectric substrate, and a rear end face of a rearmost first metal strip of the first metal strips is located on the same plane as a rear end face of the dielectric substrate; a center distance between every two adjacent first metal strips of the first metal strips is 0.1λ, λ=c/f, c is the wave velocity and meets: c=3*10^8 m/s, and f is a center operating frequency of the broadband panel array antenna; the second metal layer comprises M second metal strips attached to the upper surface of the dielectric substrate, each of the second metal strips is in an isosceles trapezoid shape, a connecting line between a midpoint of an upper line and a midpoint of a lower line of each of the second metal strips is located on a vertical plane where a diagonal line of the upper surface of the dielectric substrate is located, planes where two legs of each of the second metal strips are located overlap with planes where two adjacent end faces of the dielectric substrate are located, and the M first metal strips are in one-to-one correspondence with the M second metal strips; and regarding the first metal strips and the second metal strips corresponding to the first metal strips, if the first metal strips are mapped onto the upper surface of the dielectric substrate and are then anticlockwise rotated by 45°, the front end faces of the first metal strips overlap with the upper lines of the second metal strips, and the rear end faces of the first metal strips overlap with the lower lines of the second metal strips.

3. The broadband panel array antenna according to claim 1, wherein the radiating layer comprises a first panel and a radiating array disposed on the first panel, wherein the first panel is rectangular, the radiating array is formed by $n^2$ radiating units which are distributed in $2^{(k-1)}$ rows and $2^{(k-1)}$ columns, $n=2^{(k-1)}$, k is an integer which is greater than or equal to 3, a center distance between every two adjacent radiating units of the radiating units in the same row is 1.8λ, and a center distance between every two adjacent radiating units of the radiating units in the same column is 1.8λ; each of the radiating units comprises two first radiating elements and two second radiating elements, wherein the two first radiating elements are parallelly arranged left and right in a spaced manner, the first radiating element on the left overlaps with the first radiating element on the right after being moved rightwards by 0.9λ, the two second radiating elements are arranged left and right in a spaced manner, the second radiating element on the left overlaps with the second radiating element on the right after being moved rightwards by 0.9λ, the two second radiating elements are located behind the two first radiating elements, a center distance between the second radiating element on the left and the first radiating element on the left is 0.9λ, the second radiating element on the left and the first radiating element on the left are symmetrical front and back, a center distance between the second radiating element on the right and the first radiating element on the right is 0.9λ, and the second radiating element on the right and the first radiating element on the right are symmetrical front and back; the first radiating element comprises a first rectangular cavity, a second rectangular cavity, a third rectangular cavity, a fourth rectangular cavity, a first rectangular matching board, a second rectangular matching board and a third rectangular matching board, the first rectangular cavity, the second rectangular cavity, the third rectangular cavity and the fourth rectangular cavity are formed in the first panel and are sequentially stacked and communicated from top to bottom, a center of the first rectangular cavity, a center of the second rectangular cavity, a center of the third rectangular cavity and a center of the fourth rectangular cavity are located on the same straight line, a front end face of the first rectangular cavity, a front end face of the second rectangular cavity, a front end face of the third rectangular cavity and a front end face of the fourth rectangular cavity are parallel to a front end face of the first panel, an upper end face of the first rectangular cavity is located on the same plane as an upper end face of the first panel, an upper end face of the second rectangular cavity is located on the same plane as a lower end face of the first rectangular cavity, an upper end face of the third rectangular cavity is located on the same plane as a lower end face of the second rectangular cavity, an upper end face of the fourth rectangular cavity is located on the same plane as a lower end face of the third rectangular cavity, a lower end face of the fourth rectangular cavity is located on the same plane as a lower end face of the first panel, a left-right length of the first rectangular cavity is 0.8λ, a front-back length of the first rectangular cavity is 0.7λ, a height of the first rectangular cavity is 0.25λ, a left-right length of the second rectangular cavity is 0.6λ, a front-back length of the second rectangular cavity is 0.5λ, a height of the second rectangular cavity is 0.125λ, a left-right length of the third rectangular cavity is 0.6λ, a front-back length of the third rectangular cavity is less than 0.5λ, a height of the third rectangular cavity is 0.3λ, a left-right length of the fourth rectangular cavity is half of the left-right length of the first rectangular cavity, a front-back length of the fourth rectangular cavity is two fifths of the front-back length of the first rectangular cavity, the first rectangular matching board and the second rectangular matching board are located in the third rectangular cavity, a rear wall of the first rectangular matching board is attached and integrally connected to a rear wall of the third rectangular cavity, a distance from a left end face of the first rectangular matching board to a left end face of the third rectangular cavity is equal to a distance from a right end face of the first rectangular matching board to a right end face of the third rectangular cavity, a left-right length of the first rectangular matching board is a quarter of the left-right length of the third rectangular cavity, a front-back length of the first rectangular matching board is one-tenth of the front-back length of the third rectangular cavity, an upper end face of the first rectangular matching board is located on the same plane as the upper end face of the third rectangular cavity, a lower end face of the first rectangular matching board is located on the same plane as the lower end face of the third rectangular cavity, the second rectangular matching board and the first rectangular matching board are symmetrical front and back with respect to a front-back bisection plane of the third rectangular cavity, the third rectangular matching board is located in the fourth rectangular cavity, a front wall of the third rectangular matching board is attached and integrally connected to a front wall of the fourth rectangular cavity, a distance from the left end face of the third rectangular matching board to a left end face of the fourth rectangular cavity is equal to a distance from a right end face of the third rectangular matching board to a right end face of the fourth rectangular cavity, an upper end face of the third rectangular matching board is located on the same plane as the upper end face of the fourth rectangular cavity, the lower end face of the third rectangular matching board is located on the same plane as the lower end face of the fourth rectangular cavity, a left-right length of the third rectangular matching board is three tenths of the left-right length of the fourth rectangular cavity, a front-back length of the third rectangular matching board is half of the front-back length of the fourth rectangular cavity, and the lower end face of the fourth rectangular cavity is used as input terminals of the first radiating elements; the input terminals of the two first radiating elements and input terminals of the two second radiating elements are used as fourth input terminals of the radiating unit, the four input terminals of each of the radiating units are used as four of input terminals of the radiating layer, number of the input terminals of the radiating layer is $4*n^2$, the upper end face of the first rectangular cavity is used as output terminals of the first radiating elements, the output terminals of the two first radiating elements and output terminals of the two second radiating elements are used as four output terminals of the radiating unit, the four output terminals of each of the radiating units are used as four of output terminals of the radiating layer, number of the output terminals of the radiating layer is $4*n^2$, $4*n^2$ paths of the TE10 mode signals output by the feed layer are accessed to the $4*n^2$ input terminals of the radiating layer in a one-to-one corresponding manner, and the $4*n^2$ output terminals of the radiating layer are used for radiating the $4*n^2$ paths of TE10 mode signals output by the feed layer to the free space in a one-to-one corresponding manner.

4. The broadband panel array antenna according to claim 1, wherein the feed layer comprises a second panel, and $$\left(\frac{n}{2^1}\right)^2$$

first-stage H-type E-plane waveguide power dividing network units and a standard waveguide input port disposed on the second panel, wherein the second panel is rectangular; each of the first-stage H-type E-plane waveguide power dividing network units comprises a first-stage H-type E-plane waveguide power dividing network and a second-stage H-type E-plane waveguide power divider, wherein the second-stage H-type E-plane waveguide power divider has an input terminal and four output terminals and is used for dividing one path of signals input to the input terminal of the second-stage H-type E-plane waveguide power divider into four paths of same-power in-phase signals, which are then respectively output by the output terminals of the second-stage H-type E-plane waveguide power divider, the input terminal of the second-stage H-type E-plane waveguide power divider is used as an input terminal of the first-stage H-type E-plane waveguide power dividing network unit, the first-stage H-type E-plane waveguide power dividing network comprises two first H-type E-plane waveguide power dividing networks and two second H-type E-plane waveguide power dividing networks, the two first H-type E-plane waveguide power dividing networks are parallelly arranged left and right in a spaced manner, the first H-type E-plane waveguide power dividing network on the left overlaps with the first H-type E-plane waveguide power dividing network on the right after being moved rightwards by 1.8λ, the two second H-type E-plane waveguide power dividing networks are arranged left and right in a spaced manner, the second H-type E-plane waveguide power dividing network on the left overlaps with the second H-type E-plane waveguide power dividing network on the right after being moved rightwards by 1.8λ, the two second H-type E-plane waveguide power dividing networks are located behind the two first H-type E-plane waveguide power dividing networks, a center distance between the second H-type E-plane waveguide power dividing network on the left and the first H-type E-plane waveguide power dividing network on the left is 1.8λ, the second H-type E-plane waveguide power dividing network on the left and the first H-type E-plane waveguide power dividing network on the left are symmetrical front and back, a center distance between the second H-type E-plane waveguide power dividing network on the right and the first H-type E-plane waveguide power dividing network on the right is 1.8λ, and the second H-type E-plane waveguide power dividing network on the right and the first H-type E-plane waveguide power dividing network on the right are symmetrical front and back; the first H-type E-plane waveguide power dividing network comprises a first-stage H-type E-plane waveguide power divider and four E-plane rectangular waveguide-single ridge waveguide converters, wherein the first-stage H-type E-plane waveguide power divider has an input terminal and four output terminals and divides one path of signals input to the input terminal of the first-stage H-type E-plane waveguide power divider into four paths of same-power in-phase signals, which are then respectively output by the four output terminals of the first-stage H-type E-plane waveguide power divider, each of the E-plane rectangular waveguide-single ridge waveguide converters has an input terminal and an output terminal and is used for converting a rectangular waveguide accessed to the input terminal of the E-plane rectangular waveguide-single ridge waveguide converter into a single ridge waveguide, which is then output by the output terminal of the E-plane rectangular waveguide-single ridge waveguide converter, the input terminals of the four E-plane rectangular waveguide-single ridge waveguide converters are connected to the four output terminals of the first-stage H-type E-plane waveguide power divider in a one-to-one corresponding manner, the output terminal of each of the E-plane rectangular waveguide-single ridge waveguide converters is used as one of output terminals of the first H-type E-plane waveguide power dividing network, number of the output terminals of the first H-type E-plane waveguide power dividing network is four, the four output terminals of each of the two first H-type E-plane waveguide power dividing networks and four output terminals of each of the two second H-type E-plane waveguide power dividing networks are used as output terminals of the first-stage H-type E-plane waveguide power dividing network unit, number of the output terminals of each of the first-stage H-type E-plane waveguide power dividing network units is sixteen, number of the output terminals of the $$\left(\frac{n}{2^1}\right)^2$$

first-stage H-type E-plane waveguide power dividing network units is $$16*\left(\frac{n}{2^1}\right)^2,$$

and the $$16*\left(\frac{n}{2^1}\right)^2$$

output terminals of the $$\left(\frac{n}{2^1}\right)^2$$

first-stage H-type E-plane waveguide power dividing network units are used as $$16*\left(\frac{n}{2^1}\right)^2$$

output terminals of the feed layer and are connected to the $4n^2$ input terminals of the radiating layer in a one-to-one corresponding manner; the $$\left(\frac{n}{2^1}\right)^2$$

first-stage H-type E-plane waveguide power dividing network units are uniformly distributed in $$\frac{n}{2^1}$$

rows and $$\frac{n}{2^1}$$

columns at intervals to form a first-stage feed network array, a center distance between every two adjacent first-stage H-type E-plane waveguide power dividing network units of the first-stage H-type E-plane waveguide power dividing network units in the same row is 3.6λ, and a center distance between every two adjacent first-stage H-type E-plane waveguide power dividing network units of the first-stage H-type E-plane waveguide power dividing network units in the same column is 3.6λ; from a first row and a first column of the first-stage feed network array, four first-stage H-type E-plane waveguide power dividing network units of the first-stage H-type E-plane waveguide power dividing network units in every two rows of the rows and two columns of the columns constitute one of first-stage network unit groups, number of the first-stage network unit groups of the first-stage feed network array is $$\left(\frac{n}{2^2}\right)^2$$

in total, each of the first-stage network unit groups comprises a third-stage H-type E-plane waveguide power divider which has an input terminal and four output terminals and is used for dividing one path of signals input to the input terminal of the third-stage H-type E-plane waveguide power divider into four paths of same-power in-phase signals, which are then output by the four output terminals of third-stage H-type E-plane waveguide power divider, the four output terminals of the third-stage H-type E-plane waveguide power divider are connected to the input terminals of the four first-stage H-type E-plane waveguide power dividing network units in the first-stage network unit group in a one-to-one corresponding manner, each of the first-stage network unit groups and the third-stage H-type E-plane waveguide power divider connected to the first-stage network unit group constitute a second-stage H-type E-plane waveguide power dividing network unit, the input terminal of the third-stage H-type E-plane waveguide power divider is used as an input terminal of the second-stage H-type E-plane waveguide power dividing network unit, and $$\left(\frac{n}{2^2}\right)^2$$

second-stage H-type E-plane waveguide power dividing network units which are distributed in $$\frac{n}{2^2}$$

rows and $$\frac{n}{2^2}$$

columns are obtained in total and constitute a second-stage feed network array; from a first row and a first column of the second-stage feed network array, four second-stage H-type E-plane waveguide power dividing network units in every two rows of the rows and two columns of the columns constitute one of second-stage network unit groups, number of the second-stage network unit groups of the second-stage feed network array is $$\left(\frac{n}{2^3}\right)^2,$$

the input terminal of the third-stage H-type E-plane waveguide power divider of each of the second-stage H-type E-plane waveguide power dividing network units in the second-stage network unit group is used as one of input terminals of the second-stage network unit group, and number of the input terminals of the second-stage network unit group is four; each of the second-stage network unit groups comprises a fourth-stage H-type E-plane waveguide power divider which has an input terminal and four output terminals and is used for dividing one path of signals input to the input terminal of the fourth-stage H-type E-plane waveguide power divider into four paths of same-power in-phase signals, which are then respectively output by the four output terminals of the fourth-stage H-type E-plane waveguide power divider, and the four output terminals of the fourth-stage H-type E-plane waveguide power divider are connected to the four input terminal of the second-stage network unit group in a one-to-one corresponding manner; each of the second-stage network unit groups and the fourth-stage H-type E-plane waveguide power divider connected to the second-stage network unit group constitute one of third-stage H-type E-plane waveguide power dividing network units, the input terminal of the fourth-stage H-type E-plane waveguide power divider is used as an input terminal of each of the third-stage H-type E-plane waveguide power dividing network units, and number of the third-stage H-type E-plane waveguide power dividing network units is $$\left(\frac{n}{2^3}\right)^2,$$

the $$\left(\frac{n}{2^3}\right)^2$$

third-stage H-type E-plane waveguide power dividing network units which are distributed in $$\frac{n}{2^3}$$

rows and $$\frac{n}{2^3}$$

columns are obtained in total and constitute a third-stage feed network array; by analogy, $$\left(\frac{n}{2^{k-2}}\right)^2$$

(k-2)$^{th}$-stage H-type E-plane waveguide power dividing network units constitute a (k-2)$^{th}$ feed network array, a (k-1)$^{th}$-stage H-type E-plane waveguide power divider is arranged among four of the (k-2)$^{th}$-stage H-type E-plane waveguide power dividing network units in the (k-2)$^{th}$ feed network array, has an input terminal and four output terminals, and is used for dividing one path of signals input to the input terminal of the (k-1)$^{th}$-stage H-type E-plane waveguide power divider into four paths of same-power in-phase signals, which are then respectively output by the four output terminals of the (k-1)$^{th}$-stage H-type E-plane waveguide power divider, the four output terminals of the (k-1)$^{th}$-stage H-type E-plane waveguide power divider are connected to input terminals of the four (k-2)$^{th}$-stage H-type E-plane waveguide power dividing network units in a one-to-one corresponding manner, the input terminal of the (k-1)$^{th}$-stage H-type E-plane waveguide power divider is connected to the standard waveguide input port, the standard waveguide input port is used as an input terminal of the feed layer, and the input terminal of the feed layer is connected to an external signal port.

5. The broadband panel array antenna according to claim 1, wherein a E-plane rectangular waveguide-single ridge converter comprises a first rectangular metal block, a rectangular port and a fifth rectangular cavity are formed in the first rectangular metal block, the rectangular port is an input terminal of the E-plane rectangular waveguide-single ridge converter, an upper end face of the rectangular port is a certain distance away from an upper end face of the first rectangular metal block, a front end face of the rectangular port is located on the same plane as a front end face of the first rectangular metal block, an upper end face of the fifth rectangular cavity is located on the same plane as the upper end face of the first rectangular metal block, a right end face of the fifth rectangular cavity is located on the same plane as a right end face of the rectangular port, a front end face of the fifth rectangular cavity is connected and attached to a rear end face of the rectangular port, a lower end face of the fifth rectangular cavity is located on the same plane as a lower end face of the rectangular port, a plane where a left end face of the rectangular port is located is a certain distance away from a plane where a left end face of the fifth rectangular cavity is located, the left end face of the fifth rectangular cavity is a certain distance away from a left end face of the first rectangular metal block, a distance from the left end face of the fifth rectangular cavity to the left end face of the first rectangular metal block is equal to a distance from the right end face of the fifth rectangular cavity to the right end face of the first rectangular metal block, the lower end face of the fifth rectangular cavity is a certain distance away from a lower end face of the first rectangular metal block, a single-ridge step, an E-plane step and an H-plane step are disposed in the fifth rectangular cavity and are all rectangular blocks, a right end face of the H-plane step is connected and attached to the right end face of the fifth rectangular cavity, a lower end face of the H-plane step is connected and attached to the lower end face of the fifth rectangular cavity, a left end face of the H-plane step is connected and attached to a right end face of the single-ridge step, a lower end face of the single-ridge step is connected and attached to the lower end face of the fifth rectangular cavity, an upper end face of the single-ridge step is located on the same plane as the upper end face of the fifth rectangular cavity, a left end face of the single-ridge step is connected and attached to a right end face of the E-plane step, a left end face of the E-plane step is connected and attached to the left end face of the fifth rectangular cavity, and a lower end face of the E-plane step is connected and attached to the lower end face of the fifth rectangular cavity; a front-back length of the H-plane step is half of a front-back length of the fifth rectangular cavity, a left-right length of the H-plane step is one third of a left-right length of the fifth rectangular cavity, a vertical length of the H-plane step is two fifths of a vertical length of the fifth rectangular cavity, a front-back length of the single-ridge step is half of the front-back length of the fifth rectangular cavity, a left-right length of the single-ridge step is one third of the left-right length of the fifth rectangular cavity, a vertical length of the single-ridge step is equal to the vertical length of the fifth rectangular cavity, a front-back length of the E-plane step is equal to that the front-back length of the fifth rectangular cavity, a left-right length of the E-plane step is one third of the left-right length of the fifth rectangular cavity, a vertical length of the E-plane step is a quarter of the vertical length of the fifth rectangular cavity, and the upper end face of the fifth rectangular cavity is an output terminal of the E-plane rectangular waveguide-single ridge converter; a first-stage H-type E-plane waveguide power divider comprises a first rectangular block, a second rectangular block, a third rectangular block, a first matching block, a second matching block and a fourth rectangular block, wherein an upper end face of the first rectangular block, an upper end face of the second rectangular block, an upper end face of the third rectangular block, an upper end face of the first matching block, an upper end face of the second matching block and an upper end face of the fourth matching block are located on the same plane, a left end face of the first rectangular block is parallel to a left end face of the second panel, a front-back length of the first rectangular block is 0.7λ, a left-right length of the first rectangular block is 0.125λ, a vertical length of the first rectangular block is 0.8λ, a left end face of the third rectangular block is connected and attached to a right end face of the first rectangular block, a front-back length of the third rectangular block is 0.125λ, a left-right length of the third rectangular block is 0.9λ, a vertical length of the third rectangular block is 0.8λ, a distance from a plane where a front end face of the third rectangular block is located to a plane where a front end face of the first rectangular block is located is equal to a distance from a plane where a rear end face of the third rectangular block is located to a plane where a rear end face of the first rectangular block is located, a right end face of the third rectangular block is connected and attached to a left end face of the second rectangular block, a front-back length of the second rectangular block is 0.7λ, a left-right length of the second rectangular block is 0.125λ, a vertical length of the second rectangular block is 0.8λ, a distance from a plane where the front end face of the third rectangular block is located to a plane where a front end face of the second rectangular block is located is equal to the distance from a plane where the rear end face of the third rectangular block is located to a plane where a rear end face of the second rectangular block is located, the first matching block is a rectangular block, a left end face of the first matching block is connected and attached to the right end face of the first rectangular block, a rear end face of the first matching block is connected and attached to the front end face of the third rectangular block, a front-back length of the first matching block is one-tenth of the front-back length of the first rectangular block, a left-right length of the first matching block is four fifths of the left-right length of the first rectangular block, a vertical length of the first matching block is 0.8λ, the second matching block and the first matching block are symmetrical left and right with respect to a front-back midline of the third rectangular block, a front end face of the fourth rectangular block is connected and attached to the rear end face of the third rectangular block, a distance from a left end face of the fourth rectangular block to the right end face of the first rectangular block is equal to a distance from a right end face of the fourth rectangular block to the left end face of the second rectangular block, a left-right length of the fourth rectangular block is 1.25 times of the left-right length of the first rectangular block, a vertical length of the fourth rectangular block is 0.8λ, and the front end face of the first rectangular block, the rear end face of the first rectangular block, the front end face of the second rectangular block and the rear end face of the second rectangular block are used as four output terminals of the first-stage H-type E-plane waveguide power divider respectively; a second-stage H-type E-plane waveguide power divider comprises a fifth rectangular block, a sixth rectangular block, a seventh rectangular block, an eighth rectangular block, a first conversion block, a second conversion block, a third conversion block and a fourth conversion block, wherein an upper end face of the fifth rectangular block, an upper end face of the sixth rectangular block, an upper end face of the seventh rectangular block, an upper end face of the first conversion block, an upper end face of the second conversion block, an upper end face of the third conversion block, an upper end face of the fourth conversion block and an upper end face of the eighth rectangular block are located on the same plane, a front-back length of the fifth rectangular block is 1.2λ, a left-right length of the fifth rectangular block is 0.125λ, a vertical length of the fifth rectangular block is 0.8λ, a first rectangular recess is formed in a left end face of the fifth rectangular block, a vertical length of the first rectangular recess is equal to the vertical length of the fifth rectangular block, a front-back length of the first rectangular recess is smaller than of the front-back length of the fifth rectangular cavity, a left-right length of the first rectangular recess is smaller than a left-right length of the fifth rectangular cavity, a distance from a plane where a front end face of the first rectangular recess is located to a plane where a front end face of the fifth rectangular block is located is equal to a distance from a plane where a rear end face of the first rectangular recess to a plane where a rear end face of the fifth rectangular block is located, the sixth rectangular block and the fifth rectangular block are symmetrical left and right, a center distance between the sixth rectangular block and the fifth rectangular block is 1.9λ, a left end face of the seventh rectangular block is connected and attached to a right end face of the fifth rectangular block, a right end face of the seventh rectangular block is connected and attached to a left end face of the sixth rectangular block, a front-back length of the seventh rectangular block is 0.2λ, a left-right length of the seventh rectangular block is 1.9λ, a vertical length of the seventh rectangular block is 0.8λ, a distance from a plane where a front end face of the seventh rectangular block is located to a plane where the front end face of the fifth rectangular block is located is equal to a distance from a plane where a rear end face of the seventh rectangular block is located to a plane where the rear end face of the fifth rectangular block is located, a stepped recess is formed in a front end face of the seventh rectangular cavity and comprises a second rectangular recess and a third rectangular recess which are communicated with each other, a vertical length of the second rectangular recess and the third rectangular recess is equal to a vertical length of the seventh rectangular block, a left-right length of the second rectangular recess is smaller than a left-right length of the third rectangular recess, a left-right length of the third rectangular recess is smaller than a left-right length of the seventh rectangular block, a front-back length of the second rectangular recess is smaller than a front-back length of the third rectangular recess, a sum of the front-back length of the second rectangular recess and the front-back length of the third rectangular recess is smaller than the front-back length of the seventh rectangular block, a front end face of the third rectangular recess is located on the same plane as the front end face of the seventh rectangular block, a rear end face of the third rectangular recess is connected and attached to a front end face of the second rectangular recess, a distance from a left end face of the third rectangular recess to the left end face of the seventh rectangular block is equal to a distance from a right end face of the third rectangular recess to the right end face of the seventh rectangular block, and the distance from the left end face of the second rectangular recess to the left end face of the seventh rectangular block is equal to the distance from the right end face of the second rectangular recess to the right end face of the seventh rectangular block; a left-right length of the eighth rectangular block is 1.1 times the left-right length of the fifth rectangular block, a front end face of the eighth rectangular block is connected and attached to the rear end face of the seventh rectangular block, a distance from a left end face of the eighth rectangular block to the right end face of the fifth rectangular block is equal to a distance from a right end face of the eighth rectangular block to the left end face of the sixth rectangular block, a vertical length of the eighth rectangular block is 0.8λ, a front-back length of the eighth rectangular block is 0.2λ, a left-right length of the eighth rectangular block is 0. 2λ, and a rear end face of the eighth rectangular block is an input terminal of the second-stage H-type E-plane waveguide power divider; the first conversion block consists of a ninth rectangular block, a first right-angle triangular block, a second right-angle triangular block and a parallelogram block, wherein the ninth rectangular block, the first right-angle triangular block, the second right-angle triangular block and the parallelogram block are located on the same plane, a front end face of the ninth rectangular block is a front end face of the first conversion block, a left-right length of the ninth rectangular block is equal to 0.2λ, a vertical length of the ninth rectangular block is equal to 0.8λ, an end face where a first right-angle side of the first right-angle triangular block is located is connected and attached to a rear end face of the ninth rectangular block, a length of the end face where the first right-angle side of the first right-angle triangular block is located is equal to the left-right length of the ninth rectangular block, an end face, where a second right-angle side of the first right-angle triangular block is located, is located on the same plane as a left end face of the ninth rectangular block, a vertical length of the first right-angle triangular block is equal to the vertical length of the ninth rectangular block, an end face where a first right-angle side of the second right-angle triangular block is located is connected and attached to the front end face of the fifth rectangular block, an end face, where a second right-angle side of the second right-angle triangular block is located, is located on the same plane as the right end face of the fifth rectangular block, a length of the end face where the first right-angle side of the second right-angle triangular block is located is equal to the left-right length of the fifth rectangular block, a vertical length of the second right-angle triangular block is equal to the vertical length of the fifth rectangular block, a front end face of the parallelogram block completely overlaps with an end face where a hypotenuse of the second right-angle second triangular block is located, a distance between the front end face and a rear end face of the parallelogram block is 0.2λ, a vertical length of the parallelogram block is equal to the vertical length of the second right-angle triangular block, an angle between the end face where the first right-angle side of the first right-angle triangular block is located and the end face where a hypotenuse of the first right-angle second triangular block is located is 22.5°, and an angle between the end face where the first right-angle side of the second right-angle triangular block is located and the end face where the hypotenuse of the second right-angle second triangular block is located is 22.5°; the second conversion block and the first conversion block are symmetrical left and right, the third conversion block overlaps with the second conversion block after being moved rightward by 1.9λ, the third conversion block and the first conversion block are symmetrical front and back, a center distance between the third conversion block and the first conversion block is 1.2λ, the fourth conversion block and the second conversion block are symmetrical front and back, and the front end face of the first conversion block, a front end face of the second conversion block, a front end face of the third conversion block and a front end face of the fourth conversion block are used as four output terminals of the second-stage H-type E-plane waveguide power divider; a $h^{th}$-stage H-type E-plane waveguide power divider is identical in structure with the second-stage H-type E-plane waveguide power divider, but a size is increased gradually, and h=3, 4, . . . , k-1; when the four output terminals of each of the first-stage H-type E-plane waveguide power dividers are connected to input terminals of four E-plane rectangular waveguide-single ridge waveguide converters in a one-to-one corresponding manner, each of the output terminals of the first-stage H-type E-plane waveguide power divider is attached to and completely overlaps with the input terminal of one of the E-plane rectangular waveguide-single ridge waveguide converters; when the four output terminals of each of the second-stage H-type E-plane waveguide power dividers are connected to four input terminals of the first-stage H-type E-plane waveguide power dividers in a one-to-one corresponding manner, each of the output terminals of the second-stage H-type E-plane waveguide power divider is attached to and completely overlaps with the input terminal of one of the first-stage H-type E-plane waveguide power dividers; and when four output terminals of the $h^{th}$-stage H-type E-plane waveguide power divider are connected to input terminals of four $(h\text{-}\mathbf{1})^{th}$-stage H-type E-plane waveguide power dividers in a one-to-one corresponding manner, each of the output terminals of the $h^{th}$-stage H-type E-plane waveguide power divider is attached to and completely overlaps with the input terminal of one of the $(h\text{-}\mathbf{1})^{th}$-stage H-type E-plane waveguide power dividers.

* * * * *